US011471898B2

(12) United States Patent
Bobusch et al.

(10) Patent No.: US 11,471,898 B2
(45) Date of Patent: Oct. 18, 2022

(54) FLUIDIC COMPONENT

(71) Applicant: FDX Fluid Dynamix GmbH, Berlin (DE)

(72) Inventors: Bernhard Bobusch, Berlin (DE); Oliver Krüger, Berlin (DE); Jens Wintering, Berlin (DE)

(73) Assignee: FDX Fluid Dynamix GmbH, Berlin (DE)

( * ) Notice: Subject to any disclaimer, the term of this patent is extended or adjusted under 35 U.S.C. 154(b) by 0 days.

(21) Appl. No.: 16/832,861

(22) Filed: Mar. 27, 2020

(65) Prior Publication Data

US 2020/0238304 A1 Jul. 30, 2020

Related U.S. Application Data

(63) Continuation of application No. 15/773,344, filed as application No. PCT/EP2016/077864 on Nov. 16, 2016, now abandoned.

(30) Foreign Application Priority Data

Nov. 18, 2015 (DE) ..... 10 2015 222 771.5
Jul. 29, 2016 (DE) ..... 20 2016 104 170.8

(51) Int. Cl.
*F15C 1/22* (2006.01)
*B05B 1/08* (2006.01)
(Continued)

(52) U.S. Cl.
CPC ..... *B05B 1/08* (2013.01); *F02M 61/1806* (2013.01); *F15B 21/12* (2013.01); *B05B 1/10* (2013.01)

(58) Field of Classification Search
CPC ..... B05B 1/08; B05B 1/00; F02M 61/1806; F15B 21/12
(Continued)

(56) References Cited

U.S. PATENT DOCUMENTS 3,016,066 A ‡ 1/1962 Warren ..... F15C 1/08 137/83
3,185,166 A ‡ 5/1965 Horton ..... F15C 1/22 137/83
(Continued)

FOREIGN PATENT DOCUMENTS

CN 1130939 A ‡ 9/1996 ..... F15C 1/22
CN 1130939 A 9/1996
(Continued)

OTHER PUBLICATIONS

Phillips et al., "The Dynamics of Separation Control on a Rapidly Actuated Flap", American Institute of Aeronautics and Astronautics, 2010, pp. 1-16.‡

*Primary Examiner* — Minh Q Le
(74) *Attorney, Agent, or Firm* — The Webb Law Firm

(57) ABSTRACT

A fluidic component having a flow chamber allowing a fluid flow to flow through, said fluid flow entering the flow chamber through an inlet opening of the flow chamber and emerging from the flow chamber through an outlet opening of the flow chamber, and which flow chamber has at least one means for changing the direction of the fluid flow at the outlet opening in a controlled manner. The flow chamber has a main flow channel, which interconnects the inlet opening and the outlet opening, and at least one auxiliary flow channel as a means for changing the direction of the fluid flow at the outlet opening in a controlled manner. The inlet opening has a larger cross-sectional area than the outlet opening or the inlet opening and the outlet opening have cross-sectional areas that are equal in size.

18 Claims, 12 Drawing Sheets

(51) Int. Cl.
*F15B 21/12* (2006.01)
*F02M 61/18* (2006.01)
*B05B 1/10* (2006.01)

(58) Field of Classification Search
USPC ..... 137/833, 834, 935, 826, 825, 839, 841, 137/561 A
See application file for complete search history.

(56) References Cited

U.S. PATENT DOCUMENTS 3,563,462 A ‡ 2/1971 Bauer ..... B05B 1/08 239/44
3,690,171 A ‡ 9/1972 Tippetts ..... G01F 1/3227 73/861
3,748,852 A ‡ 7/1973 Cole ..... F02B 15/00 60/725
3,902,367 A ‡ 9/1975 Grant ..... G01F 1/3227 73/861
3,973,558 A ‡ 8/1976 Stouffer ..... A61C 17/02 601/16
4,052,002 A 10/1977 Stouffer et al.
4,151,955 A 5/1979 Stouffer
4,196,858 A ‡ 4/1980 Schulze ..... B05B 1/12 239/52
4,244,230 A ‡ 1/1981 Bauer ..... G01F 1/3227 73/861
4,307,840 A ‡ 12/1981 Schulze ..... B05B 1/00 239/45
4,407,032 A ‡ 10/1983 Bauer ..... B05B 1/08 8/158
4,463,904 A 8/1984 Bray, Jr.
4,508,267 A 4/1985 Stouffer
4,645,126 A ‡ 2/1987 Bray, Jr. ..... B05B 1/08 239/11
4,721,251 A ‡ 1/1988 Kondo ..... B05B 1/08 137/83
4,863,302 A ‡ 9/1989 Herzfeld ..... A46B 5/0095 401/28
5,524,660 A 6/1996 Dugan
5,525,161 A ‡ 6/1996 Milocco ..... A47L 15/0047 134/18
5,597,122 A ‡ 1/1997 Eisenmann ..... B05B 1/048 239/58
5,638,867 A ‡ 6/1997 Huang ..... F15C 1/22 137/82
5,749,525 A ‡ 5/1998 Stouffer ..... B05B 1/08 137/83
5,820,034 A 10/1998 Hess
5,845,845 A ‡ 12/1998 Merke ..... B05B 1/08 239/1
5,906,317 A 5/1999 Srinath
6,110,292 A ‡ 8/2000 Jewett ..... A61L 2/0088
6,457,658 B2 ‡ 10/2002 Srinath ..... B05B 1/08 239/58
6,708,898 B1 3/2004 Hoffmann et al.
6,948,244 B1 9/2005 Crockett
7,014,131 B2 ‡ 3/2006 Berning ..... B05B 1/08 239/58
7,128,082 B1 10/2006 Cerretelli et al.
7,267,290 B2 9/2007 Gopalan et al.
7,293,722 B1 11/2007 Srinath et al.
7,314,188 B2 ‡ 1/2008 Watson ..... A47L 15/16 239/56
7,951,244 B2 ‡ 5/2011 Becker ..... B08B 3/022 134/13
8,091,434 B2 ‡ 1/2012 Vaidya ..... G01F 1/3227 73/861
8,702,020 B2 ‡ 4/2014 Gopalan ..... B05B 1/08 239/58
8,733,401 B2 ‡ 5/2014 Schultz ..... E21B 28/00 137/83
9,371,131 B2 ‡ 6/2016 Bauer ..... B64C 21/08
2002/0060254 A1 5/2002 Bandemer et al.
2004/0020208 A1 2/2004 Knight
2004/0050980 A1 ‡ 3/2004 Riha ..... B05B 1/08 239/58
2004/0117937 A1 6/2004 Maruyama et al.
2004/0168671 A1 9/2004 Yamaguchi et al.
2004/0251315 A1 ‡ 12/2004 Maruyama ..... B05B 1/042 239/28
2005/0087633 A1 4/2005 Gopalan
2006/0065765 A1 3/2006 Hester et al.
2006/0226266 A1 10/2006 Russell et al.
2006/0243823 A1 ‡ 11/2006 Bachmann ..... B60S 1/52 239/28
2006/0278258 A1 ‡ 12/2006 Kara ..... A47L 15/23 134/56
2007/0295840 A1 ‡ 12/2007 Gopalan ..... B05B 1/08 239/58
2009/0188991 A1 7/2009 Russell et al.
2010/0123031 A1 5/2010 Weber
2011/0061692 A1 ‡ 3/2011 Gopalan ..... B60S 1/52 134/16
2011/0139907 A1 ‡ 6/2011 Lutz ..... B05B 3/0422 239/58
2012/0144832 A1 ‡ 6/2012 Herbon ..... F23R 3/286 60/737
2013/0240644 A1 ‡ 9/2013 Zhou ..... B05B 1/08 239/58
2014/0158090 A1 ‡ 6/2014 Sumida ..... F02M 61/1853 123/44
2015/0238982 A1 8/2015 Koklu
2015/0238983 A1 8/2015 Koklu
2017/0136472 A1 5/2017 Gopalan et al.

FOREIGN PATENT DOCUMENTS

CN 1179199 A 4/1998
CN 2653112 Y 11/2004
CN 1254314 C ‡ 5/2006 ..... B05B 1/042
CN 1254314 C 5/2006
CN 101094723 A ‡ 12/2007 ..... B60S 1/52
CN 101094723 A 12/2007
CN 102059178 A ‡ 5/2011 ..... B05B 1/08
CN 102059178 A 5/2011
CN 202410860 U 9/2012
DE 2051804 A1 ‡ 5/1971 ..... G01P 5/14
DE 2051804 A1 5/1971
DE 2414970 A1 10/1974
DE 2414970 A1 ‡ 10/1974 ..... G01F 1/3227
DE 2505695 A1 4/1976
DE 2505695 A1 ‡ 4/1976 ..... B05B 1/08
DE 2736314 A1 2/1979
DE 2736314 A1 ‡ 2/1979 ..... B05B 1/12
DE 2757522 B1 ‡ 3/1979 ..... B05B 7/065
DE 2757522 B1 3/1979
DE 2906648 C3 8/1980
DE 2906648 C3 ‡ 8/1980 ..... B05B 1/00
DE 3400934 C2 ‡ 12/1984 ..... A46B 5/0095
DE 3400934 C2 12/1984
DE 4303762 A1 ‡ 8/1994 ..... B05B 1/042
DE 4303762 A1 8/1994
DE 19544985 A1 ‡ 6/1996 ..... F15C 1/22
DE 19544985 A1 6/1996
DE 29918178 U1 ‡ 12/1999 ..... B05B 7/066
DE 29918178 U1 12/1999
DE 20019430 U1 ‡ 7/2001 ..... B05B 3/0463
DE 20019430 U1 7/2001
DE 10144574 A1 3/2003
DE 10144574 A1 ‡ 3/2003 ..... D21F 1/32
DE 69717615 T2 ‡ 1/2004 ..... F15C 1/22
DE 69717615 T2 1/2004
DE 10324494 A1 ‡ 4/2004 ..... B05B 1/08
DE 10324494 A1 4/2004
DE 19854127 B4 ‡ 10/2005 ..... B60S 1/52
DE 19854127 B4 10/2005
DE 69836224 T2 ‡ 8/2007 ..... A61L 2/0088
DE 69836224 T2 8/2007
DE 102006012080 A1 ‡ 9/2007 ..... A47L 15/23
DE 102006012080 A1 9/2007

(56) References Cited

FOREIGN PATENT DOCUMENTS

| | | | | | |
|---|---|---|---|---|---|
| DE | 102007012878 | B3 | ‡ | 10/2008 | B05B 3/1057 |
| DE | 102007012878 | B3 | | 10/2008 | |
| DE | 202009003800 | | ‡ | 7/2009 | |
| DE | 10122433 | B4 | | 4/2012 | |
| DE | 10122433 | B4 | ‡ | 4/2012 | B08B 3/026 |
| DE | 102011054258 | A1 | ‡ | 6/2012 | F23R 3/14 |
| DE | 102011054258 | A1 | | 6/2012 | |
| DE | 102011006865 | A1 | ‡ | 10/2012 | B05B 3/002 |
| DE | 102011006865 | A1 | | 10/2012 | |
| DE | 1020110788587 | A1 | | 1/2013 | |
| DE | 1020110788587 | A1 | ‡ | 1/2013 | |
| DE | 102012200289 | A1 | | 7/2013 | |
| DE | 102012200289 | A1 | ‡ | 7/2013 | F24C 15/327 |
| DE | 102012217263 | A1 | ‡ | 3/2014 | F23R 3/286 |
| DE | 102012217263 | A1 | | 3/2014 | |
| DE | 102013224969 | A1 | ‡ | 6/2014 | F02M 61/162 |
| DE | 102013224969 | A1 | | 6/2014 | |
| EP | 0044331 | B1 | ‡ | 1/1982 | B05B 1/08 |
| EP | 0044331 | B1 | | 1/1982 | |
| EP | 0659381 | B1 | ‡ | 6/1995 | A47L 15/0047 |
| EP | 0659381 | B1 | | 6/1995 | |
| EP | 1040786 | B1 | ‡ | 10/2000 | A47L 15/4282 |
| EP | 1040786 | B1 | | 10/2000 | |
| EP | 1053059 | B1 | ‡ | 11/2000 | B05B 1/08 |
| EP | 1053059 | B1 | | 11/2000 | |
| EP | 1472966 | A2 | ‡ | 11/2004 | A47L 15/4278 |
| EP | 1472966 | A2 | | 11/2004 | |
| EP | 1486158 | B1 | | 12/2004 | |
| EP | 1486158 | B1 | ‡ | 12/2004 | A47L 15/247 |
| EP | 1513711 | B1 | | 3/2005 | |
| EP | 1513711 | B1 | ‡ | 3/2005 | F15C 1/22 |
| EP | 165 8209 | B1 | ‡ | 5/2006 | B60S 1/52 |
| EP | 1658209 | B1 | | 5/2006 | |
| EP | 1827703 | B1 | ‡ | 9/2007 | B60S 1/52 |
| EP | 1827703 | B1 | | 9/2007 | |
| EP | 2101922 | B1 | | 9/2009 | |
| EP | 2101922 | B1 | ‡ | 9/2009 | E03D 9/002 |
| EP | 2332657 | A1 | | 6/2011 | |
| EP | 2332657 | A1 | ‡ | 6/2011 | B05B 1/08 |
| EP | 2650213 | B1 | ‡ | 10/2013 | B64C 21/06 |
| EP | 2650213 | B1 | | 10/2013 | |
| GB | 2295535 | A | | 6/1996 | |
| GB | 2295535 | A | ‡ | 6/1996 | B05B 1/08 |
| WO | 2007139891 | A1 | | 12/2007 | |
| WO | WO-2007139891 | A1 | ‡ | 12/2007 | B60S 1/52 |
| WO | 20100105760 | A1 | | 9/2010 | |
| WO | WO-2010105760 | A1 | ‡ | 9/2010 | E01H 5/092 |

‡ imported from a related application

FLUIDIC COMPONENT

CROSS-REFERENCE TO A RELATED APPLICATION

This application is a continuation of U.S. application Ser. No. 15/773,344, filed on May 3, 2018, which is the United States national phase of International Application No. PCT/EP2016/077864, filed on Nov. 16, 2016, which claims priority to German Patent Application Nos. 10 2015 222 771.5 and 20 2016 104 170.8, filed on Nov. 18, 2015 and Jul. 29, 2016, respectively, the disclosures of which are hereby incorporated by reference in their entireties.

BACKGROUND

The invention relates to a fluidic component and to a cleaning appliance which comprises a fluidic component of this kind. The fluidic component is provided for the purpose of producing a moving fluid jet.

For the production of a fluid jet with a high speed or high momentum, the prior art contains nozzles which are designed to subject the fluid jet to a pressure which is higher than the ambient pressure. By means of the nozzle, the fluid is accelerated and/or directed or concentrated. In order to produce a movement of a fluid jet, the nozzle is generally moved by means of a device. To produce a moving fluid jet, an additional device is thus required apart from the nozzle. This additional device comprises moving component parts, which easily wear. The costs associated with production and maintenance are correspondingly high. Another disadvantage is the fact that a relatively large installation space is required overall owing to the moving component parts.

Fluidic components are furthermore known for the production of a moving fluid flow (or fluid jet). The fluidic components do not comprise any moving component parts serving to produce a moving fluid flow. As a result, in comparison with the nozzles mentioned at the outset, they do not have the disadvantages resulting from the moving component parts. However, a steep pressure gradient often occurs within the fluidic components in the case of the known fluidic components, and therefore cavitation, i.e., the formation of cavities (bubbles), can occur within the components as the liquid fluid flow flows through the fluidic components. As a result, there can be a massive reduction in the life of the components or failure of the fluidic components may be caused. Moreover, the known fluidic components are more suitable for the wetting of surfaces than for the production of a fluid jet with a high speed or a high momentum. Thus, a fluid flow emerging from a known fluidic component has the spray characteristic of a fan nozzle, which produces a finely atomized jet.

SUMMARY

It is the underlying object of the present invention to provide a fluidic component which is designed to make available a moving fluid jet with a high speed or high pressure, wherein the fluidic component has high failure resistance and a correspondingly lower maintenance cost.

According to the invention, this object is achieved by a fluidic component having features as described herein.

Accordingly, the fluidic component comprises a flow chamber allowing a fluid to flow through. The fluid flow can be a liquid flow or a gas flow. The flow chamber comprises an inlet opening and an outlet opening, through which the fluid flow enters the flow chamber and reemerges from the flow chamber. The fluidic component furthermore comprises at least one means for changing the direction of the fluid flow at the outlet opening in a controlled manner, wherein, in particular, the means is designed to generate a spatial oscillation of the fluid flow at the outlet opening. The flow chamber has a main flow channel, which interconnects the inlet opening and the outlet opening, and at least one auxiliary flow channel as the at least one means for changing the direction of the fluid flow at the outlet opening in a controlled manner.

The fluidic component is distinguished by the fact that the inlet opening has a larger cross-sectional area than the outlet opening or that the inlet opening and the outlet opening have cross-sectional areas that are equal in size. Here, the cross-sectional areas of the inlet opening and of the outlet opening should each be taken to mean the smallest cross-sectional areas of the fluidic component through which the fluid flow passes when it enters the flow chamber and reemerges from the flow chamber.

This ensures that a fluid jet which oscillates in space (and time) emerges from the fluidic component, said jet having a high speed or a high momentum. The emerging fluid jet is furthermore compact, that is to say that the fluid jet fans out spatially or spreads apart only at a late stage (a long way downstream), not directly at the outlet opening.

In the arrangement according to the invention, it is possible to dispense with moving component parts for the production of an oscillating jet, and therefore costs and effort arising therefrom do not occur. Moreover, dispensing with moving component parts means that the generation of vibration and noise by the fluidic component according to the invention is relatively low.

Moreover, the occurrence of cavitation within the fluidic component (and the disadvantages resulting therefrom) is avoided through the choice according to the invention of the size ratio of the inlet opening to that of the outlet opening. Contrary to the prevailing opinion, the formation of the oscillating fluid jet is not impaired by the fact that the outlet opening has a smaller cross-sectional area than the inlet opening.

Owing to its compactness and high speed, the spatially oscillating fluid jet which emerges from the fluidic component according to the invention has a high removal and cleaning power when it is directed at a surface. The fluidic component according to the invention can therefore be employed in cleaning systems, for example. The fluidic component according to the invention is also relevant to mixing systems (in which two or more different fluids are supposed to be mixed with one another) and manufacturing systems (e.g., waterjet cutting). Thus, for example, the effectiveness of waterjet cutting can be increased with a pulsating fluid jet emerging from the fluidic component according to the invention.

In principle, the cross-sectional area of the inlet opening can be equal in size to or larger than the cross-sectional area of the outlet opening. The size ratio can be chosen in accordance with the desired characteristics (speed or momentum, compactness, oscillation frequency) of the emerging jet. However, other parameters, e.g., the size (e.g., the volume and/or component depth, component width, component length) of the fluidic component, the shape of the fluidic component, the type of fluid (gas, low-viscosity liquid, high-viscosity liquid), the level of the pressure at which the fluid flow enters the fluidic component, the entry speed of the fluid and the volume flow, can also influence the choice of size ratio. The oscillation frequency can be between 0.5 Hz and 30 kHz. A preferred frequency range is between 3 Hz and 400 Hz. The inlet pressure can be between 0.01 bar and 6000 bar above ambient pressure. For some applications, (referred to as) low-pressure applications, e.g., for washing machines or dishwashers, the inlet pressure is typically between 0.01 bar and 12 bar above ambient pressure. For other applications (referred to as high-pressure applications), e.g., for cleaning (vehicles, semifinished products, machines or stables) or mixing two different fluids, the inlet pressure is typically between 5 bar and 300 bar.

According to a preferred embodiment, the cross-sectional area of the inlet opening can be larger by a factor of up to 2.5 than the cross-sectional area of the outlet opening. According to a particularly preferred embodiment, the cross-sectional area of the inlet opening can be larger by a factor of up to 1.5 than the cross-sectional area of the outlet opening.

Moreover, the cross-sectional area of the outlet opening can have any desired shape, e.g., square, rectangular, polygonal, round, oval etc. A corresponding statement applies to the cross-sectional area of the inlet opening. In this case, the shape of the inlet opening can correspond to the shape of the outlet opening or differ therefrom. A round cross-sectional area of the outlet opening can be chosen, for example, in order to produce a particularly compact/concentrated fluid jet. Such a fluid jet can be used, in particular, in high-pressure cleaning systems or in waterjet cutting.

According to one embodiment, both the inlet opening and the outlet opening have a rectangular cross section. In this case, the inlet opening can have a greater width than the outlet opening.

In this case, the width of the inlet and outlet openings is defined in relation to the geometry of the fluidic component. For example, the fluidic component can be of substantially cuboidal design and, accordingly, can have a component length, a component width and a component depth, wherein the component length determines the distance between the inlet opening and the outlet opening, and the component width and component depth are each defined perpendicularly to one another and to the component length and wherein the component width is greater than the component depth. Thus, the component length extends substantially parallel to the main direction of extent of the fluid flow, which moves from the inlet opening to the outlet opening in accordance with the intended purpose. If the inlet and outlet openings are situated on an axis which extends parallel to the component length, the distance between the inlet and outlet openings corresponds to the component length. If the inlet and outlet openings are arranged offset relative to one another, that is to say said axis extends at an angle unequal to 0° relative to the component length, the component length and the offset between the inlet and outlet openings determine the distance between the inlet and outlet openings along the axis. In the case of a substantially cuboidal fluidic component, the ratio of component length to component width can be 1/3 to 5.

The ratio is preferably in the range of 1/1 to 4/1. The component width can be in the range between 0.15 mm and 2.5 m. In a preferred variant embodiment, the component width is between 1.5 mm and 200 mm. Said dimensions depend, in particular, on the application for which the fluidic component is to be used.

By definition, the abovementioned width of the inlet and outlet openings extends parallel to the component width. According to one embodiment, a substantially cuboidal fluidic component can have a rectangular outlet opening with a width which corresponds to ⅓ to 1/50 of the component width and a rectangular inlet opening with a width which corresponds to ⅓ to 1/20 of the component width. According to a preferred embodiment, the width of the outlet opening can correspond to ⅕ to 1/15 of the component width, and the width of the inlet opening can correspond to ⅕ to 1/10 of the component width. The ratio of the component depth to the width of the inlet opening can be 1/20 to 5. This ratio is also referred to as the aspect ratio. A preferred aspect ratio is between 1/6 and 2. The size ratios mentioned also depend, in particular, on the application for which the fluidic component is to be used.

According to another embodiment, the fluidic component has a component depth which is constant over the entire component length. As an alternative, the component depth can decrease from the inlet opening toward the outlet opening (continuously (with or without a constant rise) or in steps). By means of the decreasing component depth, the fluid jet is pre-concentrated within the fluidic component, ensuring that a compact fluid jet emerges from the fluidic component. Expansion or spreading apart of the fluid jet can thus be delayed and therefore does not take place directly at the outlet opening but only further downstream. This measure is advantageous, for example, in cleaning systems or in waterjet systems. According to another alternative, the component depth can increase from the inlet opening toward the outlet opening, wherein the component width decreases in such a way that the cross-sectional area of the outlet opening is smaller than or equal in size to the cross-sectional area of the inlet opening.

As a means for changing the direction of the fluid flow at the outlet opening in a controlled manner, the flow chamber has at least one auxiliary flow channel. Part of the fluid flow, the auxiliary flow, is allowed to flow through the auxiliary flow channel. That part of the fluid flow which does not enter the auxiliary flow channel but emerges from the fluidic component is referred to as the main flow. The at least one auxiliary flow channel can have an inlet which is situated in proximity to the outlet opening and an outlet which is situated in proximity to the inlet opening. When viewed in the fluid flow direction (from the inlet opening to the outlet opening), the at least one auxiliary flow channel can be arranged at the side of (not after or before) the main flow channel. In particular, it is possible to provide two auxiliary flow channels, which extend at the side of the main flow channel (when viewed in the main flow direction), wherein the main flow channel is arranged between the two auxiliary flow channels. According to a preferred embodiment, the auxiliary flow channels and the main flow channel are arranged in a row along the component width and each extend along the component length. Alternatively, the auxiliary flow channels and the main flow channel can be arranged in a row along the component depth and each extend along the component length.

The at least one auxiliary flow channel is preferably separated from the main flow channel by a block. This block can have various shapes. Thus, the cross section of the block can taper when viewed in the fluid flow direction (from the inlet opening toward the outlet opening). As an alternative, the cross section of the block can taper or increase centrally between its end facing the inlet opening and its end facing the outlet opening. An enlargement of the cross section of the block with increasing distance from the inlet opening is also possible. Moreover, the block can have rounded edges. Sharp edges can be provided on the block, in particular in the vicinity of the inlet opening and/or the outlet opening.

According to one embodiment, the at least one auxiliary flow channel can have a greater or smaller depth than the main flow channel. It is thereby possible to exercise an additional influence over the oscillation frequency of the emerging fluid jet. Reducing the component depth in the region of the at least one auxiliary flow channel (in comparison with the main flow channel) reduces the oscillation frequency if the other parameters remain substantially unchanged. Accordingly, the oscillation frequency rises if the component depth is increased in the region of the at least one auxiliary flow channel (in comparison with the main flow channel) and the other parameters remain substantially unchanged.

Another possibility for influencing the oscillation frequency of the emerging fluid jet can be created by means of at least one separator, which is preferably provided at the inlet of the at least one auxiliary flow channel. The separator assists the splitting of the auxiliary flow from the fluid flow. Here, a separator should be taken to mean an element which projects into the flow chamber (transversely to the flow direction prevailing in the auxiliary flow channel) at the inlet of the at least one auxiliary flow channel. The separator can be provided as a deformation (in particular an inward protrusion) of the auxiliary flow channel wall or as a projection designed in some other way. Thus, the separator can be of (circular) conical or pyramidal design. The use of such a separator makes it possible not only to influence the oscillation frequency but also to vary the "oscillation angle". The oscillation angle is the angle which the oscillating fluid jet covers (between its two maximum deflections). If a plurality of auxiliary flow channels is provided, a separator can be provided for each of the auxiliary flow channels or only for some of the auxiliary flow channels.

According to one embodiment, an outlet channel can be provided directly upstream of the outlet opening. The outlet channel can have a shape of the cross-sectional area which is constant over the entire length of the outlet channel and corresponds to the shape of the cross-sectional area of the outlet opening (square, rectangular, polygonal, round etc.). As an alternative, the shape of the cross-sectional area of the outlet channel can change over the length of the outlet channel. In this case, the size of the cross-sectional area of the outlet opening can remain constant (and this is then also the size of the outlet opening) or can vary. In particular, the size of the cross-sectional area of the outlet channel can decrease in the fluid flow direction from the inlet opening to the outlet opening. According to another alternative, the shape and/or size of the cross-sectional area of the main flow channel can vary from the inlet opening toward the outlet opening. Thus, in particular, the shape of the cross-sectional area (of the outlet channel or of the main flow channel) can change from rectangular to round (in the fluid flow direction from the inlet opening to the outlet opening). As a result, the fluid jet can be pre-concentrated already in the fluidic component, thus enabling the compactness of the emerging fluid jet to be increased. Furthermore, the size of the cross-sectional area of the outlet channel can vary, in particular can decrease in the fluid flow direction from the inlet opening to the outlet opening.

The shape of the outlet channel influences the oscillation angle of the emerging fluid jet and can be chosen in such a way that a desired oscillation angle is established. Apart from the abovementioned constant or variable shape of the cross-sectional area of the outlet channel, it is possible as a further feature for the outlet channel to be of rectilinear or curved design.

The parameters of the fluidic component (shape, size, number and shape of the auxiliary flow channels, (relative) size of the inlet and outlet openings) can be set in many ways. These parameters are preferably chosen in such a way that the pressure at which the fluid flow enters the fluidic component via the inlet opening is substantially dissipated at the outlet opening. Here, a slight pressure reduction in comparison with that at the outlet opening can take place already in the fluidic component (upstream of the outlet opening).

According to another embodiment, the fluidic component has two or more outlet openings. These outlet openings can be formed by arrangement of a flow divider directly upstream of the outlet openings. The flow divider is a means for splitting the fluid flow into two or more subsidiary flows. In order to achieve the effects, mentioned at the outset, of the fluidic component according to the invention with just one outlet opening, even in the embodiment with two or more outlet openings, each outlet opening can have a smaller cross-sectional area than the inlet opening, or all the outlet openings and the inlet opening can each have cross-sectional areas that are equal in size. Alternatively, it is also possible for just one of the two/of the plurality of outlet openings to have a smaller cross-sectional area than or a cross-sectional area of the same size as the inlet opening. A fluidic component with two or more outlet openings is suitable for producing two or more fluid jets which emerge from the fluidic component in a pulsed manner with respect to time. Here, a (minimal) local oscillation can occur within a pulse.

The flow divider can have various shapes but common to all of them is that they widen downstream in the plane in which the emerging fluid jet oscillates and transversely to the longitudinal axis of the fluidic component. The flow divider can be arranged in the outlet channel (if present). Moreover, the flow divider can extend deeper into the fluidic component, e.g., into the main flow channel. In this case, the flow divider can be arranged in such a symmetrical way (with respect to an axis which extends parallel to the component length) that the outlet openings are identical in shape and size. However, other positions are also possible, and these can be chosen in accordance with the desired pulse characteristic of the emerging fluid jets.

According to another embodiment, the fluidic component comprises a fluid flow guide, which is arranged downstream adjoining the outlet opening. The fluid flow guide is substantially tubular (e.g., with a cross-sectional area of constant size and a constant shape of the cross-sectional area) and can be moved by the fluid flow as said flow changes direction. The cross-sectional area of the fluid flow guide can correspond to the cross-sectional area of the outlet opening. No influence is exercised over the direction of the emerging fluid flow by means of the movement of the fluid flow guide. The fluid flow guide merely forms a means (passive construction element) for the additional concentration of the oscillating emerging fluid jet. The fluid flow concentrated in this way fans out or spreads apart only further downstream than a fluid flow which emerges from a fluidic component without a fluid flow guide. Particularly in cleaning systems, this property can be desired.

In order to avoid influencing the emerging oscillating fluid jet, a bearing arrangement, by means of which the fluid flow guide is secured movably on the outlet opening, can be provided, for example. Various joint configurations that can be used in principle are known in practice. For example, a ball joint or a solid body joint is possible. As an alternative, the fluid flow guide and/or the bearing arrangement can be manufactured from a flexible material.

It is also possible for the cross-sectional area of the outlet opening of the fluid flow guide to be implemented differently. The outlet opening of the fluid flow guide is the opening from which the fluid flow emerges from the fluid flow guide (and thus from the fluidic component). Thus, shapes for the cross-sectional area of the outlet opening of the fluid flow guide which have been described in the context of the outlet opening of the fluidic component without a fluid flow guide are possible. It is also possible for the shape of the cross-sectional area of the fluid flow guide to vary over the length of the fluid flow guide. Thus, a rectangular cross-sectional area in the region of the bearing arrangement (i.e., at the inlet of the fluid flow guide) can be provided which merges downstream into a round cross-sectional area.

According to another embodiment, the fluidic component has a widened outlet portion, which adjoins the outlet opening downstream of the outlet opening. In particular, the widened outlet portion immediately (directly) adjoins the outlet opening downstream of the outlet opening. The widened outlet portion can be of funnel-shaped design, for example. In particular, the widened outlet portion can have a cross-sectional area (perpendicularly to the fluid flow direction), the size of which increases downstream of the outlet opening. In this case, the outlet opening can form the point with the smallest cross-sectional area between the flow chamber and the widened outlet portion.

The widened outlet portion can be used to concentrate a fluid jet which undergoes a high pressure reduction at the outlet opening and hence spreads apart at the outlet opening. The widened outlet portion can therefore (at least partially) counteract the spreading apart of the fluid jet. By means of the concentration of the fluid jet, it is possible to achieve an increase in the removal or cleaning power of the fluidic component.

According to one embodiment, the widened outlet portion can have a width which increases (continuously) downstream of the outlet opening. In this case, the width is the extent of the widened outlet portion which lies in the plane in which the emerging fluid flow oscillates. In this case, the depth of the widened outlet portion can be constant. The depth of the widened outlet portion is the extent of the widened outlet portion which is oriented substantially perpendicularly to the plane in which the emerging fluid flow oscillates. Depending on the area of application of the fluidic component, the depth of the widened outlet portion can increase or decrease downstream (in comparison with the component depth at the outlet opening). By means of a downstream-oriented reduction in component depth in the region of the widened outlet portion, it is possible to achieve further focusing of the emerging fluid jet.

According to one embodiment, the widened outlet portion can be delimited by a wall which encloses an angle in the plane in which the emerging fluid jet oscillates within an oscillation angle, wherein the angle of the widened outlet portion is 0° to 15°, preferably 0° to 10°, larger than the oscillation angle. Thus, the widened outlet portion does not influence the magnitude of the oscillation angle but merely the spreading apart of the emerging fluid jet. This angle magnitude is appropriate, for example, for fluidic components which, without a widened outlet portion, produce a uniform distribution of the fluid on the surface to be sprayed. The selected angle of the widened outlet portion can also be smaller than the oscillation angle, e.g., if, without a widened outlet portion, the fluidic component produces a nonuniform distribution of the fluid on the surface to be sprayed or if the oscillation angle is to be reduced.

Downstream of the outlet opening it is possible to provide an outlet channel, the boundary walls of which enclose an angle in the plane in which the emerging fluid jet oscillates, wherein the angle of the outlet channel can be larger than the oscillation angle and also larger than the angle of the widened outlet portion. The angle of the outlet channel is preferably larger at least by a factor of 1.1 than the angle of the widened outlet portion. According to a particularly preferred embodiment, the angle of the outlet channel is in a range extending from 1.1 times the angle of the widened outlet portion to 3.5 times the angle of the widened outlet portion.

The invention furthermore relates to an injection system and to a cleaning appliance which each comprise the fluidic component according to the invention. The injection system is provided for the purpose of injecting a fuel into a combustion engine, e.g., an internal combustion engine or a gas turbine, which is used in motor vehicles, for example. In particular, the cleaning appliance is a dishwasher, a washing machine, an industrial cleaning system or a high-pressure cleaner.

BRIEF DESCRIPTION OF THE DRAWINGS

The invention is explained in greater detail below by means of illustrative embodiments in conjunction with the drawings.

DETAILED DESCRIPTION

Figure 1:
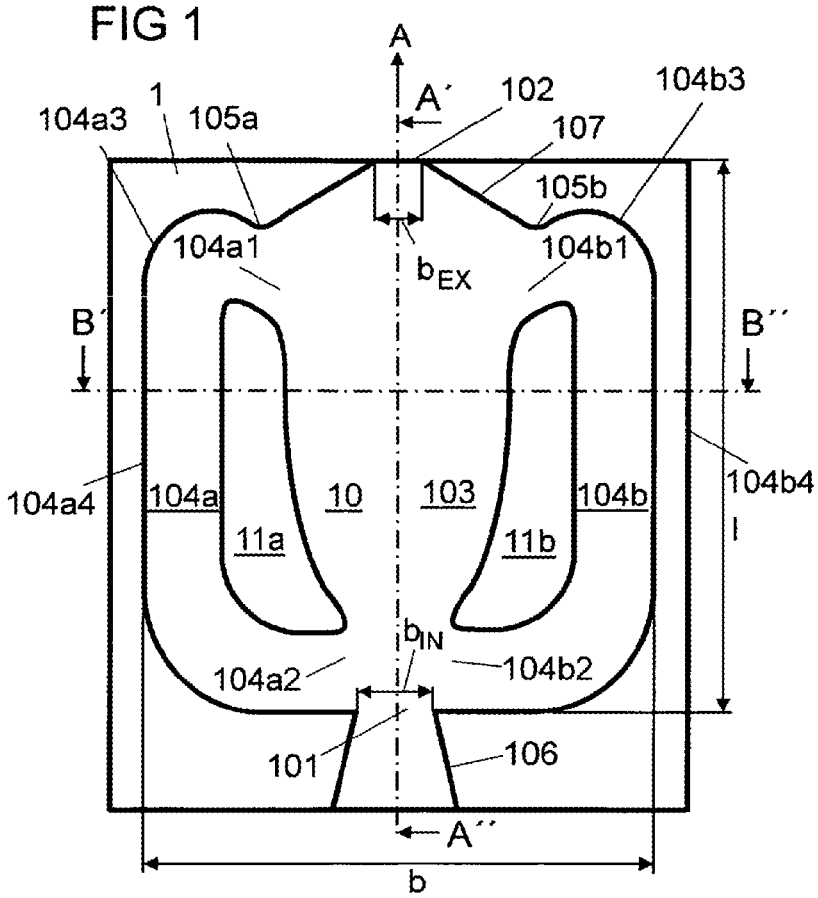
FIG. 1 shows a cross section through a fluidic component according to one embodiment of the invention.
Figure 2:
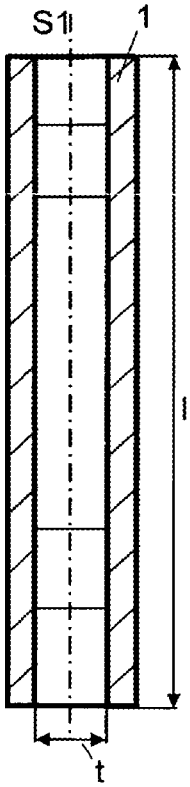
FIG. 2 shows a section through the fluidic component from FIG. 1 along the line A'-A".
Figure 3:
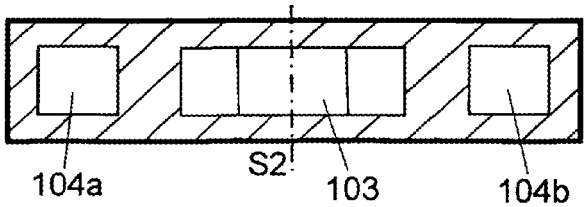
FIG. 3 shows a section through the fluidic component from FIG. 1 along the line B'-B".
Figure 4:
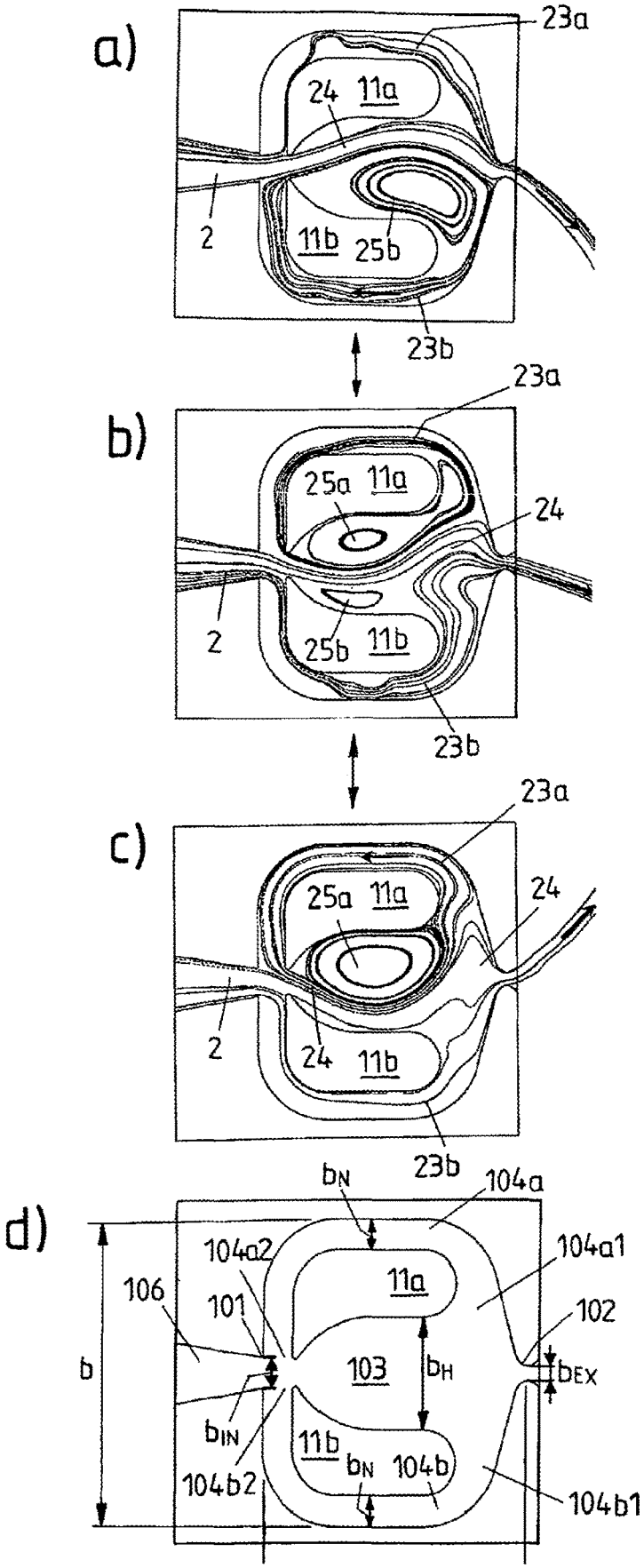
FIG. 4 shows three snapshots (images a) to c)) of an oscillation cycle of a fluid flow intended to illustrate the flow direction of the fluid flow which flows through a fluidic component according to another embodiment of the invention; a section (image d)) of the fluidic component from images a) to c) intended to illustrate the dimensions of said component.

A fluidic component 1 according to one embodiment of the invention is illustrated schematically in FIG. 1. FIGS. 2 and 3 show a section through said fluidic component 1 along the lines A'-A" and B'-B" respectively. The fluidic component 1 comprises a flow chamber 10 allowing a fluid flow 2 to flow through (FIG. 4). The flow chamber 10 is also referred to as an interaction chamber.

The flow chamber 10 comprises an inlet opening 101, via which the fluid flow 2 enters the flow chamber 10, and an outlet opening 102, via which the fluid flow 2 leaves the flow chamber 10. The inlet opening 101 and the outlet opening 102 are arranged on two opposite sides of the fluidic component 1. The fluid flow 2 moves substantially along a longitudinal axis A of the fluidic component 1 in the flow chamber 10 (said longitudinal axis connecting the inlet opening 101 and the outlet opening 102 to one another) from the inlet opening 101 to the outlet opening 102.

The longitudinal axis A forms an axis of symmetry of the fluidic component 1. The longitudinal axis A lies in two planes of symmetry S1 and S2 which are perpendicular to one another, relative to which the fluidic component 1 is mirror-symmetrical. As an alternative, the fluidic component 1 can be of non-mirror-symmetrical construction.

To change the direction of the fluid flow in a controlled manner, the flow chamber 10 has not only a main flow channel 103 but also two auxiliary flow channels 104*a*, 104*b*, wherein the main flow channel 103 is arranged between the two auxiliary flow channels 104*a*, 104*b* (when viewed transversely to the longitudinal axis A). Immediately behind the inlet opening 101, the flow chamber 10 divides into the main flow channel 103 and the two auxiliary flow channels 104*a*, 104*b*, which are then combined again immediately ahead of the outlet opening 102. The two auxiliary flow channels 104*a*, 104*b* are arranged symmetrically with respect to axis of symmetry S2 (FIG. 3). According to an alternative (not shown), the auxiliary flow channels are arranged non-symmetrically.

The main flow channel 103 connects the inlet opening 101 and the outlet opening 102 to one another substantially in a straight line, with the result that the fluid flow 2 flows substantially along the longitudinal axis A of the fluidic component 1. Starting from the inlet opening 101, the auxiliary flow channels 104*a*, 104*b* each extend initially at an angle of substantially 90° to the longitudinal axis A in opposite directions in a first section. The auxiliary flow channels 104*a*, 104*b* then bend, with the result that they each extend substantially parallel to the longitudinal axis A (in the direction of the outlet opening 102) (second section). In order to recombine the auxiliary flow channels 104*a*, 104*b* and the main flow channel 103, the auxiliary flow channels 104*a*, 104*b* change direction once again at the end of the second section, with the result that they are each oriented substantially in the direction of the longitudinal axis A (third section). In the embodiment in FIG. 1, the direction of the auxiliary flow channels 104*a*, 104*b* changes at the transition from the second to the third section by an angle of about 120°. However, it is also possible for angles other than that mentioned here to be chosen for the change in direction between these two sections of the auxiliary flow channels 104*a*, 104*b*.

The auxiliary flow channels 104*a*, 104*b* are a means for influencing the direction of the fluid flow 2 which flows through the flow chamber 10. For this purpose, the auxiliary flow channels 104*a*, 104*b* each have an inlet 104*a*1, 104*b*1, which is formed substantially by that end of the auxiliary flow channels 104*a*, 104*b* which faces the outlet opening 102, and each have an outlet 104*a*2, 104*b*2, which is formed substantially by that end of the auxiliary flow channels 104*a*, 104*b* which faces the inlet opening 101. Through the inlets 104*a*1, 104*b*1, a small part of the fluid flow 2, the auxiliary flows 23*a*, 23*b* (FIG. 4), flows into the auxiliary flow channels 104*a*, 104*b*. The remaining part of the fluid flow 2 (essentially the "main flow" 24) emerges from the fluidic component 1 via the outlet opening 102 (FIG. 4). The auxiliary flows 23*a*, 23*b* emerge from the auxiliary flow channels 104*a*, 104*b* at the outlets 104*a*2, 104*b*2, where they can exert a lateral impulse (transverse to the longitudinal axis A) on the fluid flow 2 entering through the inlet opening 101. In this case, the direction of the fluid flow 2 is influenced in such a way that the main flow 24 emerging at the outlet opening 102 oscillates spatially, more specifically in a plane in which the main flow channel 103 and the auxiliary flow channels 104*a*, 104*b* are arranged. The plane in which the main flow 24 oscillates corresponds to plane of symmetry S1 or is parallel to plane of symmetry S1. FIG. 4, which shows the oscillating fluid flow 2, will be explained in greater detail below.

The auxiliary flow channels 104*a*, 104*b* each have a cross-sectional area which is virtually constant over the entire length of the auxiliary flow channels 104*a*, 104*b* (from the inlet 104*a*1, 104*b*1 to the outlet 104*a*2, 104*b*2). As an alternative, the size and/or shape of the cross-sectional area can vary over the length of the auxiliary flow channels. In contrast, the size of the cross-sectional area of the main flow channel 103 increases continuously in the flow direction of the main flow 23 (i.e., in the direction from the inlet opening 101 to the outlet opening 102), wherein the shape of the main flow channel 103 is mirror-symmetrical with respect to the planes of symmetry S1 and S2.

The main flow channel 103 is separated from each auxiliary flow channel 104*a*, 104*b* by a block 11*a*, 11*b*. In the embodiment from FIG. 1, the two blocks 11*a*, 11*b* are identical in shape and size and arranged symmetrically with respect to mirror plane S2. In principle, however, they can also be of different design and not oriented symmetrically. In the case of non-symmetrical orientation, the shape of the main flow channel 103 is also non-symmetrical with respect to mirror plane S2. The shape of the blocks 11*a*, 11*b*, which is shown in FIG. 1, is merely illustrative and can be varied. The blocks 11*a*, 11*b* from FIG. 1 have rounded edges.

Separators 105*a*, 105*b* in the form of inward protrusions (of the boundary wall of the flow chamber 10) are furthermore provided at the inlet 104*a*1, 104*b*1 of the auxiliary flow channels 104*a*, 104*b*. In this case, an inward protrusion 105*a*, 105*b* projects at the inlet 104*a*1, 104*b*1 of each auxiliary flow channel 104*a*, 104*b* beyond a section of the circumferential edge of the auxiliary flow channel 104*a*, 104*b* into the respective auxiliary flow channel 104*a*, 104*b* and changes the cross-sectional shape thereof at this point, reducing the cross-sectional area. In the embodiment in FIG. 1, the section of the circumferential edge is chosen in such a way that each inward protrusion 105*a*, 105*b* is (inter alia also) directed at the inlet opening 101 (oriented substantially parallel to the longitudinal axis A). Alternatively, the separators 105*a*, 105*b* can be oriented differently. By means of the separators 105*a*, 105*b*, the separation of the auxiliary flows 23*a*, 23*b* from the main flow 24 is influenced and controlled. By means of the shape, size and orientation of the separators 105*a*, 105*b* it is possible to influence the volume which flows out of the fluid flow 2 into the auxiliary flow channels 104*a*, 104*b* and to influence the direction of the auxiliary flows 23*a*, 23*b*. This, in turn, leads to influencing of the exit angle of the main flow 24 at the outlet opening 102 of the fluidic component 1 (and hence to influencing of the oscillation angle) and to influencing of the frequency at which the main flow 24 oscillates at the outlet opening 102. Through the choice of the size, orientation and/or shape of the separators 105*a*, 105*b*, the profile of the main flow 24 emerging at the outlet opening 102 can thus be influenced in a controlled manner. As an alternative, it is also possible for a separator to be provided only at the inlet of one of the two auxiliary flow channels.

In the embodiment from FIG. 1, the separators 105*a*, 105*b* each have a shape which describes a circular arc in plane of symmetry S1. On the one hand, this circular arc merges tangentially into the (linear) boundary wall of the outlet channel 107. On the other hand, this circular arc merges tangentially into another circular arc 104*a*3, 104*b*3, which delimits the inlet 104*a*1, 104*b*1 of the auxiliary flow channel 104*a*, 104*b*. In this case, the circular arc of the separator 105*a*, 105*b* has a smaller radius than the circular arc 104*a*3, 104*b*3 of the inlet 104*a*1, 104*b*1 of the auxiliary flow channel 104*a*, 104*b*. The circular arc 104*a*3, 104*b*3 of the inlet 104*a*1, 104*b*1 of the auxiliary flow channel 104*a*, 104*b* furthermore merges tangentially into the boundary wall 104*a*4, 104*b*4 of the auxiliary flow channel 104*a*, 104*b*. In particular, the transition between the separators 105*a*, 105*b* and the auxiliary flow channels 104*a*, 104*b*, on the one hand, and the outlet channel 107, on the other hand, is of continuous design, without steps.

The separators 105*a*, 105*b* are formed in the boundary wall of the flow chamber 10, substantially opposite that end of the blocks 11*a*, 11*b* which faces the outlet opening 102. In particular, the separators 105*a*, 105*b* can be arranged at a distance from plane of symmetry S2 which is within the average width of the blocks 11*a*, 11*b*. The average width of a block 11*a*, 11*b* is the width which the block 11*a*, 11*b* has over half its length (when viewed in the flow direction).

Arranged upstream of the inlet opening 101 of the flow chamber 10 is a funnel-shaped extension 106, which tapers in the direction of the inlet opening 101 (downstream). The length (along the fluid flow direction) of the funnel-shaped extension 106 can be greater by a factor of at least 1.5 than the width $b_{IN}$ of the inlet opening 101. The funnel-shaped extension 106 is preferably larger by a factor of at least 3 than the width $b_{IN}$ of the inlet opening 101. The flow chamber 10 also tapers, namely in the region of the outlet opening 102. The taper is formed by an outlet channel 107, which extends between the separators 105*a*, 105*b* and the outlet opening 102. In this case, the funnel-shaped extension 106 and the outlet channel 107 taper in such a way that only the width thereof, i.e., the extent thereof in plane of symmetry S1 perpendicularly to the longitudinal axis A, decreases downstream in each case. The taper has no effect on the depth, i.e., the extent in plane of symmetry S2 perpendicularly to the longitudinal axis A, of the extension 106 and of the outlet channel 107 (FIG. 2). As an alternative, the extension 106 and the outlet channel 107 can also each taper in width and in depth. Furthermore, it is possible for only the extension 106 to taper in depth or in width, while the outlet channel 107 tapers both in width and in depth, or vice versa. The extent of the taper of the outlet channel 107 influences the directional characteristic of the fluid flow 2 emerging from the outlet opening 102 and thus the oscillation angle thereof. The shape of the funnel-shaped extension 106 and of the outlet channel 107 are shown purely by way of example in FIG. 1. Here, the width thereof in each case decreases in a linear manner downstream. Other shapes of the taper are possible.

The inlet opening 101 and the outlet opening 102 each have a rectangular cross-sectional area. These each have the same depth (extent in plane of symmetry S2 perpendicularly to the longitudinal axis A, FIG. 2) but differ in their width $b_{IN}$, $b_{EX}$ (extent in plane of symmetry S1 perpendicularly to the longitudinal axis A, FIG. 1). In particular, the outlet opening 102 is less wide than the inlet opening 101. Thus, the cross-sectional area of the outlet opening 102 is smaller than the cross-sectional area of the inlet opening 101. As an alternative, the width of the inlet opening 101 and the outlet opening 102 can be the same, while the outlet opening 102 is less deep than the inlet opening 101. In another alternative variant, both the width and the depth of the outlet opening 102 can be less than the width and depth of the inlet opening 101. In each case, the dimensions of the width and depth should be chosen so that the cross-sectional area of the outlet opening 102 is smaller than or equal in size to the cross-sectional area of the inlet opening 101.

For cleaning applications which typically operate with inlet pressures of over 14 bar, the fluidic component 1 can have an outlet width $b_{EX}$ of 0.01 mm to 18 mm. The outlet width $b_{EX}$ is preferably between 0.1 mm and 8 mm. The ratio of the width $b_{IN}$ of the inlet opening 101 to the width $b_{EX}$ of the outlet opening 102 can be 1 to 6, preferably between 1 and 2.2. In this case, the dimensions of the component depth in the region of the inlet opening 101 and of the outlet opening 102 should be chosen so that the cross-sectional area of the outlet opening 102 is smaller than or equal in size to the cross-sectional area of the inlet opening 101. The component width b can be greater by a factor of at least 4 than the outlet width $b_{EX}$. The component width b is preferably greater by a factor of 6 to 21 than the outlet width $b_{EX}$. The component length 1 can be greater by a factor of at least 6 than the outlet width $b_{EX}$. The component length 1 is preferably greater by a factor of 8 to 38 than the outlet width $b_{EX}$. The widest point of the main flow channel (the largest distance between the blocks 11*a*, 11*b* when viewed along the width of the fluidic component 1) can be greater by a factor of 2 to 18 than the outlet width $b_{EX}$. This factor is preferably between 3 and 12.

In FIG. 4, three snapshots of a fluid flow 2 are shown for the purpose of illustrating the flow direction (streamlines) of the fluid flow 2 in a fluidic component 1 during an oscillation cycle (images a) to c)). In particular, the fluidic component 1 from FIG. 4 differs from the fluidic component 1 from FIGS. 1 to 3 in that no separators are provided and that the ends of the blocks 11 which face the inlet opening 101 are less rounded. The component length 1 of the fluidic component 1 from FIG. 4 is 18 mm and the component width b is 20 mm (image d)). The width $b_{IN}$ of the inlet opening 101 and the width $b_N$ of the auxiliary flow channels 104*a*, 104*b* are the same and are each 2 mm. The outlet width $b_{EX}$ is 0.9 mm. The component depth is constant in this illustrative embodiment and is 0.9 mm. The main flow channel 103 has a maximum width $b_H$ between the blocks 11*a*, 11*b* of 8 mm. The fluid flowing through the fluidic component 1 has a pressure of 56 bar at the inlet opening 101, wherein the fluid is water. However, the fluidic component 1 illustrated is also suitable in principle for gaseous fluids.

Figure 7:
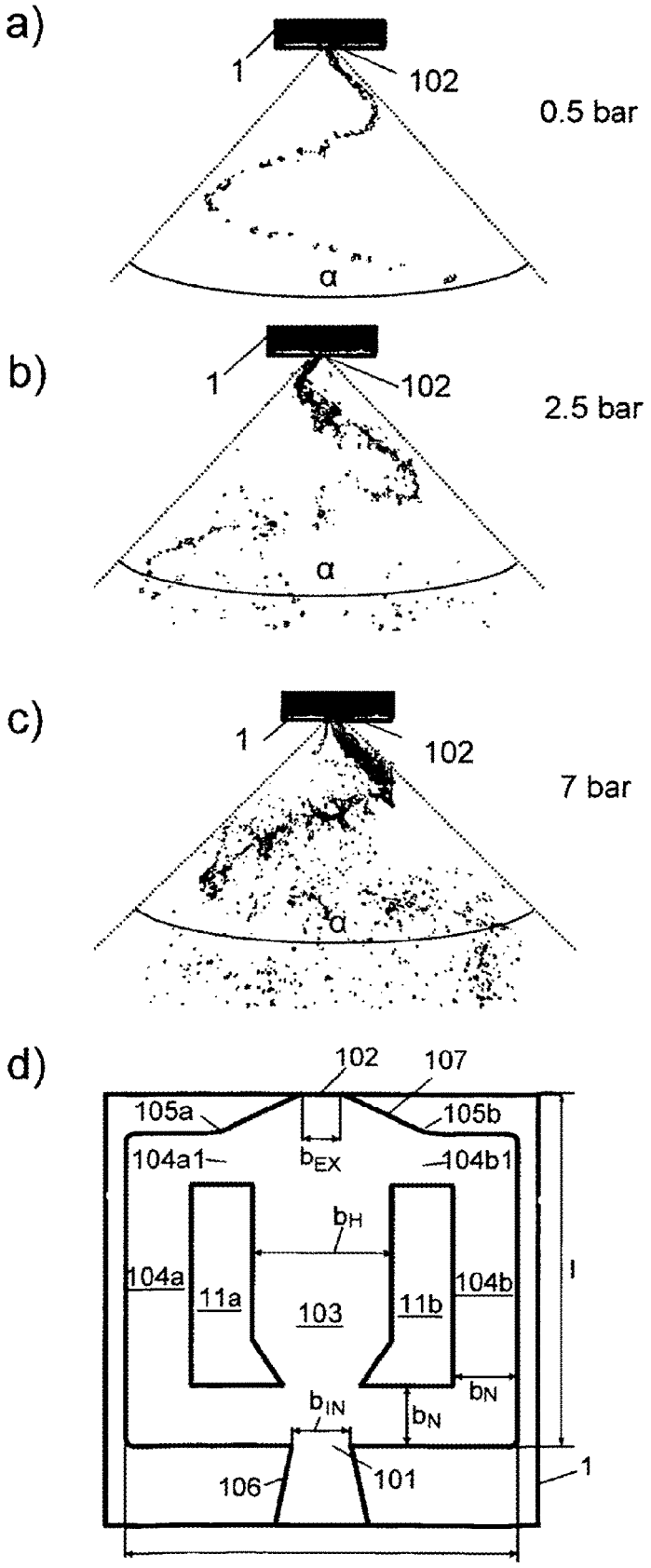
FIG. 7 shows an illustration of the fluid flow emerging from a fluidic component as a function of the pressure of the fluid flow at the inlet of the fluidic component, at a) 0.5 bar, b) 2.5 bar and c) 7 bar; a section (image d)) through the fluidic component from images a) to c) intended to illustrate the dimensions of said component.

Images a) and c) illustrate the streamlines for two deflections of the emerging main flow 24, which correspond approximately to the maximum deflections. The angle which the emerging main flow 24 covers between these two maxima is the oscillation angle α (FIG. 7). Image b) shows the streamlines for a position of the emerging main flow 24 which lies approximately in the center between the two maxima from images a) and c). The flows within the fluidic component 1 during an oscillation cycle are described below.

First of all, the fluid flow 2 is passed via the inlet opening 101 into the fluidic component 1 at an inlet pressure of bar. In the region of the inlet opening 101, the fluid flow 2 undergoes virtually no pressure loss since it is allowed to flow unhindered through into the main flow channel 103. Initially, the fluid flow 2 flows along the longitudinal axis A in the direction of the outlet opening 102.

By introducing a one-time random or selective disturbance, the fluid flow 2 is deflected sideways in the direction of the side wall of one block 11*a* which faces the main flow channel 103, with the result that the direction of the fluid flow 2 deviates to an increasing extent from the longitudinal axis A until the fluid flow has been deflected to the maximum extent. By virtue of the "Coanda effect", the majority of the fluid flow 2, the "main flow" 24, adheres to the side wall of one block 11*a* and then flows along this side wall. A recirculation zone 25*b* forms in the region between the main flow 24 and the other block 11*b*. In this case, the recirculation zone 25*b* grows the more the main flow 24 adheres to the side wall of one block 11*a*. The main flow 24 emerges from the outlet opening 102 at an angle relative to the longitudinal axis A which varies with respect to time. In FIG. 4*a*), the main flow 24 adheres to the side wall of one block 11*a* and the recirculation zone 25*b* is at its maximum size. Moreover, the main flow 24 emerges from the outlet opening 102 with approximately the greatest possible deflection.

A small part of the fluid flow 2, referred to as the auxiliary flow 23*a*, 23*b*, separates from the main flow 24 and flows into the auxiliary flow channels 104*a*, 104*b* via the inlets 104*a*1, 104*b*1 thereof. In the situation illustrated in FIG. 4*a*), (owing to the deflection of the fluid flow 2 in the direction of block 11*a*) that part of the fluid flow 2 which flows into the auxiliary flow channel 104*b* which adjoins block 11*b*, to the side wall of which the main flow 103 does not adhere, is significantly larger than that part of the fluid flow 2 which flows into the auxiliary flow channel 104*a* which adjoins block 11*a*, to the side wall of which the main flow 103 adheres. In FIG. 4*a*), therefore, auxiliary flow 23*b* is significantly greater than auxiliary flow 23*a*, which is virtually negligible. In general, the deflection of the fluid flow 2 into the auxiliary flow channels 104*a*, 104*b* can be influenced and controlled by means of separators. The auxiliary flows 23*a*, 23*b* (in particular auxiliary flow 23*b*) flow through the auxiliary flow channels 104*a* and 104*b* to their respective outlets 104*a*2, 104*b*2 and thus impart a momentum to the fluid flow 2 entering the inlet opening 101. Since auxiliary flow 23*b* is greater than auxiliary flow 23*a*, the momentum component which results from auxiliary flow 23*b* is the predominant component.

The main flow 24 is therefore pressed against the side wall of block 11*a* by the momentum (of auxiliary flow 23*b*). At the same time, the recirculation zone 25*b* moves in the direction of the inlet 104*b*1 of auxiliary flow channel 104*b*, thereby disturbing the supply of fluid to auxiliary flow channel 104*b*. The momentum component which results from auxiliary flow 23*b* therefore decreases. At the same time, the recirculation zone 25*b* shrinks, while another (growing) recirculation zone 25*a* forms between the main flow 24 and the side wall of block 11*a*. During this process, the supply of fluid to auxiliary flow channel 104*a* also increases. The momentum component which results from auxiliary flow 23*a* therefore increases. The momentum components of the auxiliary flows 23*a*, 23*b* continue to come closer and closer together until they are equal and cancel each other out. In this situation, the entering fluid flow 2 is not deflected, and therefore the main flow 24 moves approximately centrally between the two blocks 11*a*, 11*b* and emerges without deflection from the outlet opening 102. FIG. 4*b*) does not show precisely this situation but shows a situation shortly before it.

As the situation progresses, the supply of fluid to auxiliary flow channel 104*a* increases more and more, and therefore the momentum component which results from auxiliary flow 23*a* exceeds the momentum component which results from auxiliary flow 23*b*. As a result, the main flow 24 is forced further and further away from the side wall of block 11*a*, until it adheres to the side wall of the opposite block 11*b* owing to the Coanda effect (FIG. 4*c*)). During this process, recirculation zone 25*b* disappears, while recirculation zone 25*a* grows to its maximum size. The main flow 24 now emerges from the outlet opening 102 with a maximum deflection, which has the opposite sign from that in the situation from FIG. 4*a*).

The recirculation zone 25*a* will then move and block the inlet 104*a*1 of auxiliary flow channel 104*a*, with the result that the supply of fluid will fall again here. Subsequently, auxiliary flow 23*b* will supply the dominant momentum component, with the result that the main flow 24 will once again be forced away from the side wall of block 11*b*. The changes described now take place in the reverse order.

Owing to the process described, the main flow 24 emerging at the outlet opening 102 oscillates about the longitudinal axis A in a plane in which the main flow channel 103 and the auxiliary flow channels 104*a*, 104*b* are arranged, with the result that a fluid jet that sweeps backward and forward is produced. In order to achieve the effect described, a symmetrical construction of the fluidic component 1 is not absolutely necessary.

Figure 5:
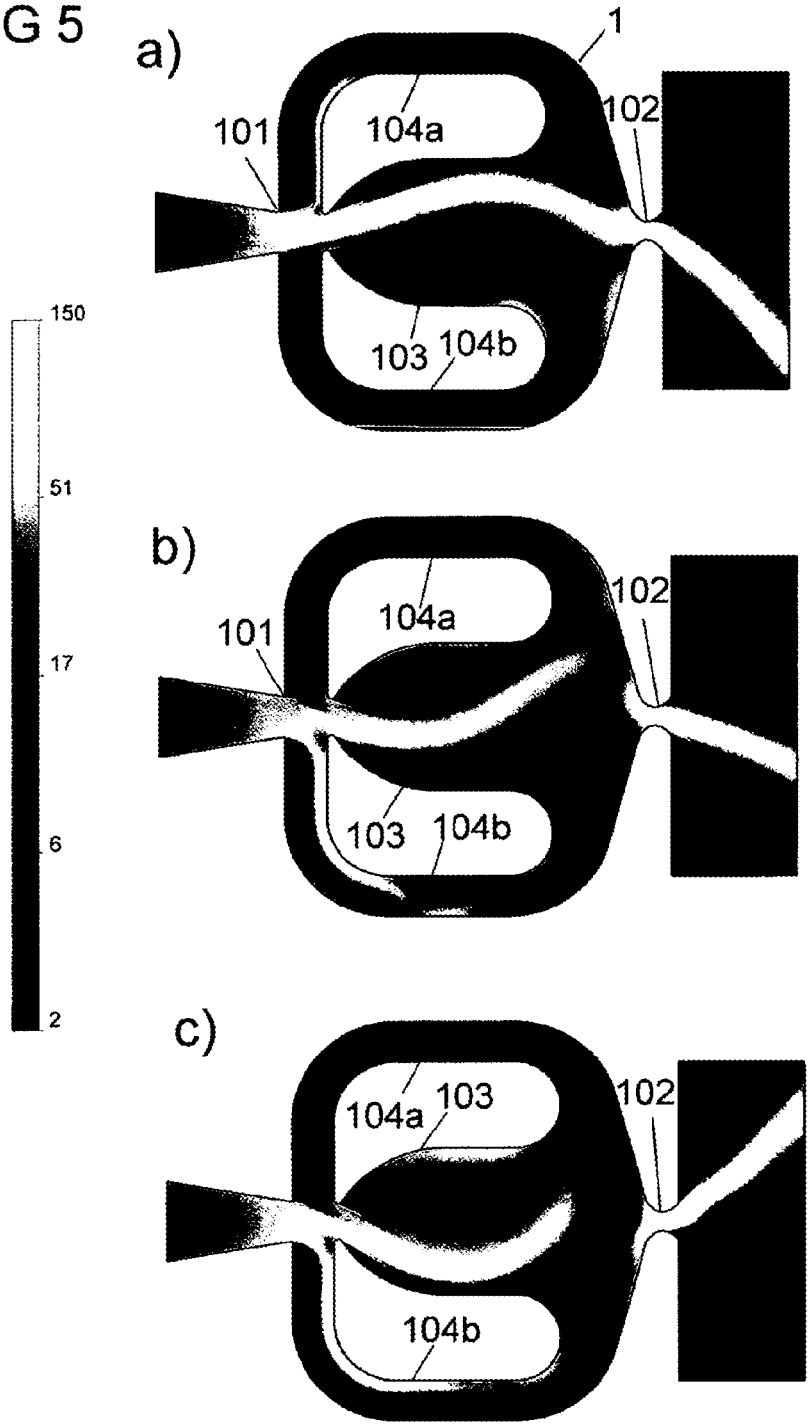
FIG. 5 shows a flow simulation for the three snapshots from FIG. 4 intended to illustrate the respective speed distribution of the fluid.

For each of the three snapshots a), b) and c) from FIG. 4, FIG. 5 shows a corresponding transient flow simulation in order to visualize the velocity field of the fluid flow 2 inside and outside the fluidic component 1. Here, FIG. 5*a*) corresponds to the snapshot from FIG. 4*a*) etc. The scale depicted in FIG. 5 converts the gray shades in which the fluid flow 2 is depicted into a speed in m/s of the fluid flow. Here, the speed is coded logarithmically with a color code. According to this, black corresponds to a fluid speed of 0 m/s, while white corresponds to a fluid speed of 150 m/s. The lighter the shade in which the fluid is depicted at a particular point, the higher is its speed at this point. Images a) to c) show that the main flow 24 emerges at the outlet opening 102 with a speed which is always higher than the speed at which the fluid flow 2 enters at the inlet opening 101. This is attributable to the fact that the outlet opening 102 has a smaller cross-sectional area than the inlet opening 101. In this example, the speed of the emerging main flow 24 is around 150 m/s. Thus, a fluid jet with a high speed or high momentum is produced. Despite the high speed of the emerging fluid jet, the oscillation mechanism is maintained.

Figure 6:
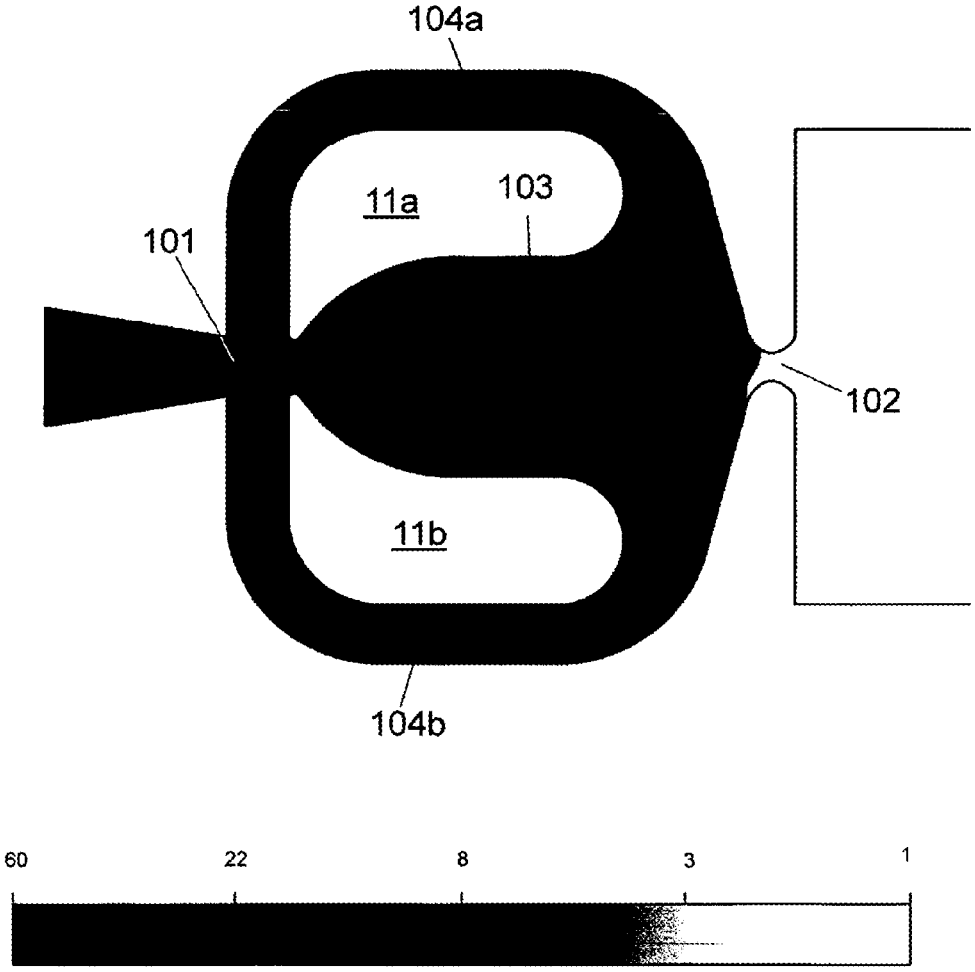
FIG. 6 shows an illustration of the pressure distribution of the fluid for the snapshot b) from FIG. 5.

FIG. 6 shows the corresponding pressure field of the fluid flow 2 for the snapshot from FIG. 4*b*) (FIG. 5*b*)). The pressure is coded logarithmically with a color code. The scale depicted ranges from 1 bar (white) to 60 bar (black). Upstream of the inlet opening 101, the pressure of the fluid is 56 bar. The ambient pressure is 1 bar (white). FIG. 6 shows clearly that the pressure of the fluid in said fluidic component 1 is high and corresponds substantially to the pressure before entry to the fluidic component 1 through the inlet opening 101. Only at the outlet opening 102 does the pressure of the fluid fall abruptly to the ambient pressure. In the context of FIG. 5*b*), it can be seen that the fluid is accelerated at this point where the fluid pressure drops.

FIGS. 7*a*) to *c*) show three individual recordings of a fluid jet emerging from a fluidic component 1 intended to illustrate the spray characteristic. The fluidic component 1 has a component length 1 of 22 mm, a component width of 23 mm and a component depth of 3 mm. The inlet opening 101 has a width $b_{IN}$ of 3 mm, and the outlet opening 102 has a width $b_{EX}$ of 2.5 mm. Separators 105*a*, 105*b* are provided at the inlets of the auxiliary flow channels 104*a*, 104*b*. The auxiliary flow channels 104*a*, 104*b* each have a constant width $b_N$ of 4 mm. The main flow channel 103 is 9 mm wide at its widest point ($b_H$). Water flows through the fluidic component 1 as the fluid, wherein the pressure of the water at the inlet opening 101 is 0.5 bar in FIG. 7*a*), 2.5 bar in FIG. 7*b*) and 7 bar in FIG. 7*c*). As the pressure of the water at the inlet opening 101 rises, the oscillation frequency f of the emerging fluid jet increases, wherein the oscillation angle $\alpha$ remains substantially the same.

Figure 8:
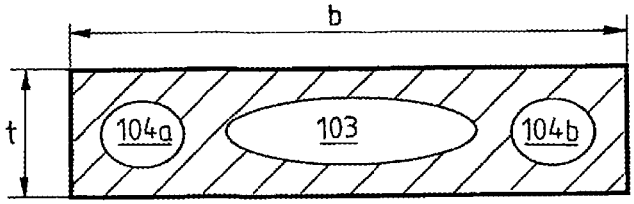
FIG. 8 shows a cross section through a fluidic component according to another embodiment of the invention, wherein the view corresponds to that from FIG. 3.
Figure 9:
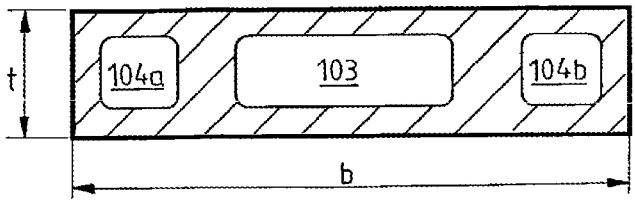
FIG. 9 shows a cross section through a fluidic component according to another embodiment of the invention, wherein the view corresponds to that from FIG. 3.

Cross sections through two further embodiments of the fluidic component 1 are illustrated in FIGS. 8 and 9. The section in FIGS. 8 and 9 corresponds to that in FIG. 3. Thus, FIGS. 8 and 9 each show a section through the fluidic component 1 transversely to the longitudinal axis A and hence a section through the main flow channel 103 and the auxiliary flow channels 104*a*, 104*b* transversely to the flow direction. The fluidic components from FIGS. 8 and 9 correspond to the fluidic component 1 from FIGS. 1 to 3 and differ therefrom only in the cross-sectional shapes of the main flow channel 103 and of the auxiliary flow channels 104*a*, 104*b*. Whereas, in the embodiment from FIG. 3, these are in each case rectangular, they are in each case oval in the embodiment from FIG. 8 and in each case rectangular with rounded corners in the embodiment from FIG. 9. The shapes illustrated should be taken to be purely illustrative. Other shapes or hybrid shapes are also possible. In this context, hybrid shapes should be taken to mean that the main flow channel 103 and the auxiliary flow channels 104*a*, 104*b* can have two or more different cross-sectional shapes, rather than the same shape. In this case, the auxiliary flow channels 104*a*, 104*b* can also have a triangular, polygonal or round cross-sectional area. However, the cross-sectional area of the main flow channel 103 generally has a shape, the extent of which along the component width b is greater than along the component depth t.

Figure 10:
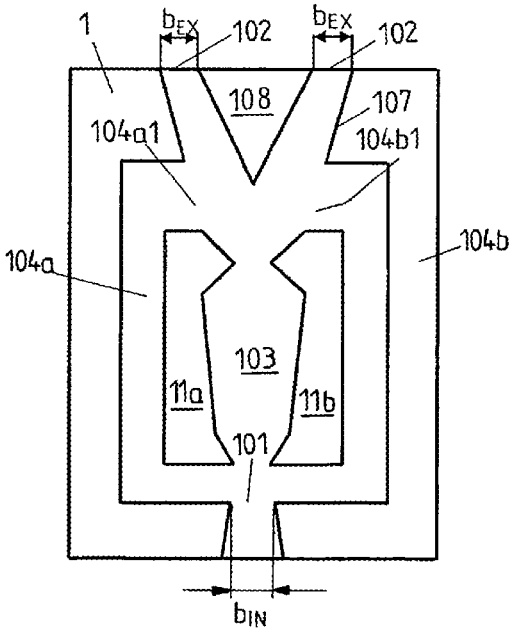
FIG. 10 shows a cross section through a fluidic component having two outlet openings.
Figure 11:
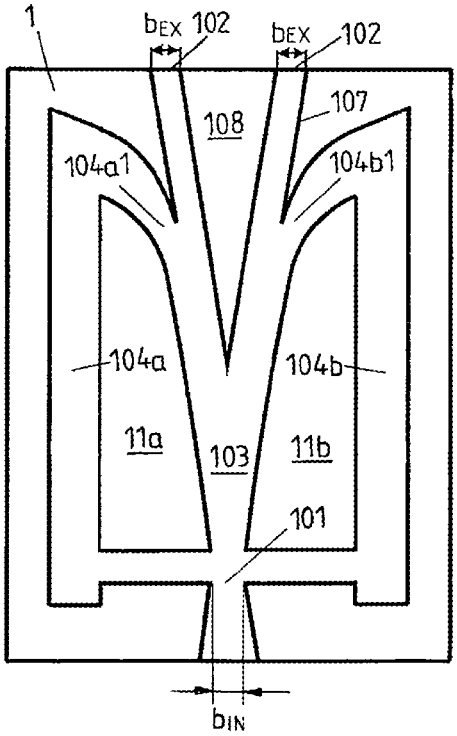
FIG. 11 shows a cross section through a fluidic component having two outlet openings according to another embodiment.

FIGS. 10 and 11 show two further embodiments of the fluidic component 1. These two embodiments differ from that in FIG. 1, in particular in that a flow divider 108 is provided in the outlet channel 107, but no separator is provided at the inlets 104*a*1, 104*b*1 of the auxiliary flow channels 104*a*, 104*b*. The shape of the blocks 11*a*, 11*b* is also different. However, the fundamental geometric properties of these two embodiments correspond to those of the fluidic component 1 from FIG. 1.

The flow divider 108 in each case has the form of a triangular wedge. The wedge has a depth which corresponds to the component depth t. (The component depth t is constant over the entire fluidic component 1.) Thus, the flow divider 108 divides the outlet channel 107 into two subordinate channels with two outlet openings 102 and divides the fluid flow 2 into two subordinate flows, which emerge from the fluidic component 1. Owing to the oscillation mechanism described in the context of FIG. 4, the two subordinate flows emerge from the two outlet openings 102 in a pulsed manner. The two outlet openings 102 each have a smaller width $b_{EX}$ than the inlet opening 101.

In the embodiment from FIG. 10, the flow divider 108 extends substantially in the outlet channel 107, while, in the embodiment from FIG. 11, it projects into the main flow channel 103. In principle, the shape and size of the flow divider 108 is freely selectable according to the desired application. Moreover, a plurality of flow dividers can be provided (adjacent to one another along the component width) in order to divide the emerging fluid jet into more than two subordinate flows.

FIGS. 10 and 11 also show two further embodiments of the blocks 11*a*, 11*b*. However, these shapes are only illustrative and are not intended to be provided exclusively in the context of the flow divider 108. Likewise, the blocks 11*a*, 11*b* can be of different design when a flow divider 108 is used. The blocks from FIG. 10 have a substantially trapezoidal basic shape which tapers downstream (in width) and from the ends of which a triangular projection protrudes into the main flow channel 103 in each case. The blocks 11*a*, 11*b* from FIG. 11 are similar to those from FIG. 1 but do not have rounded edges.

Figure 12:
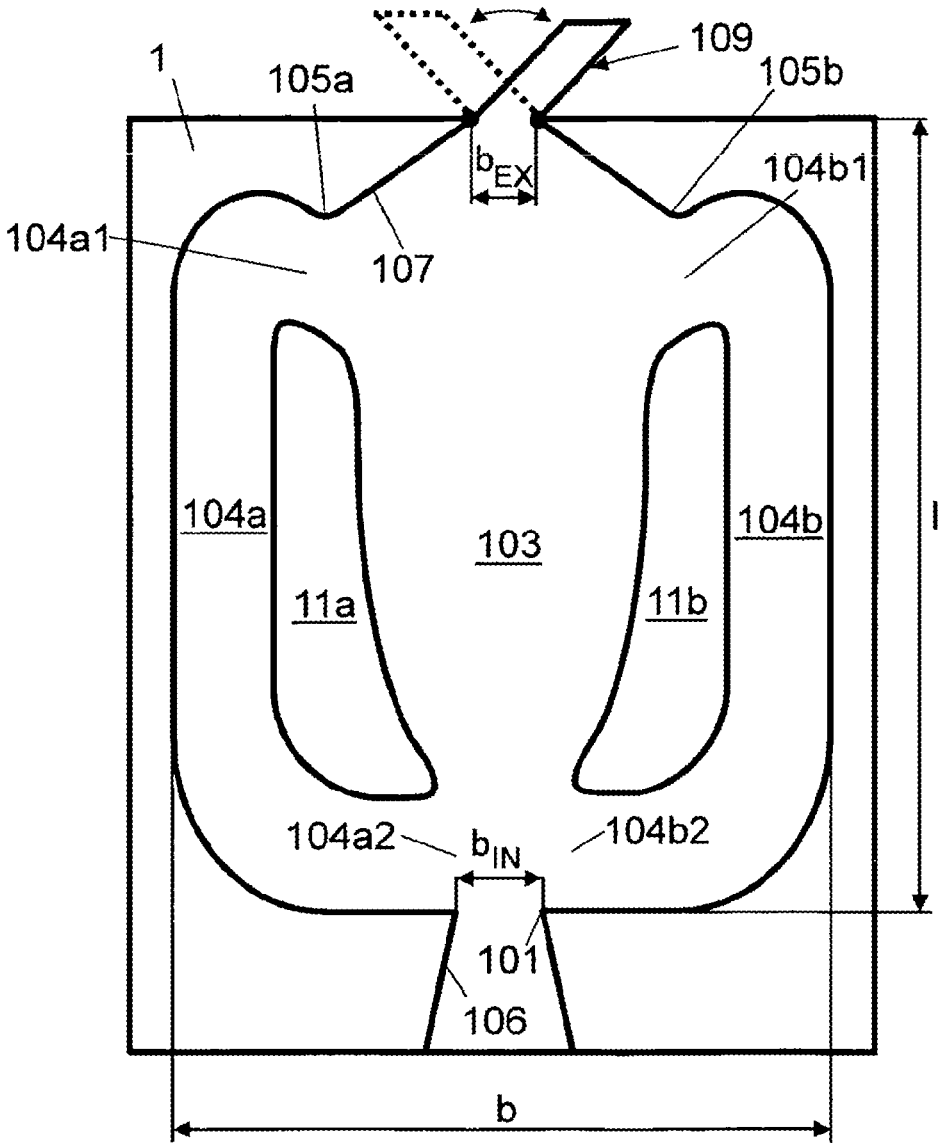
FIG. 12 shows a cross section through a fluidic component having a fluid flow guide.

FIG. 12 shows the fluidic component 1 from FIG. 1, which additionally has a fluid flow guide 109. The fluid flow guide 109 is a tubular extension, which is arranged at the outlet opening 102 and extends downstream from the outlet opening 102. The fluid flow guide 109 serves to concentrate the emerging fluid flow without affecting the oscillation mechanism in the process. The fluid flow guide 109 is arranged movably at the outlet opening 102 and is moved concomitantly by the movement of the emerging fluid flow. This is illustrated in FIG. 12 by the double arrow. In FIG. 12, one of the two maximum deflections of the fluid flow guide 109 is shown as a solid line and the other of the two maximum deflections of the fluid flow guide 109 is shown as a dotted line.

Figure 13:
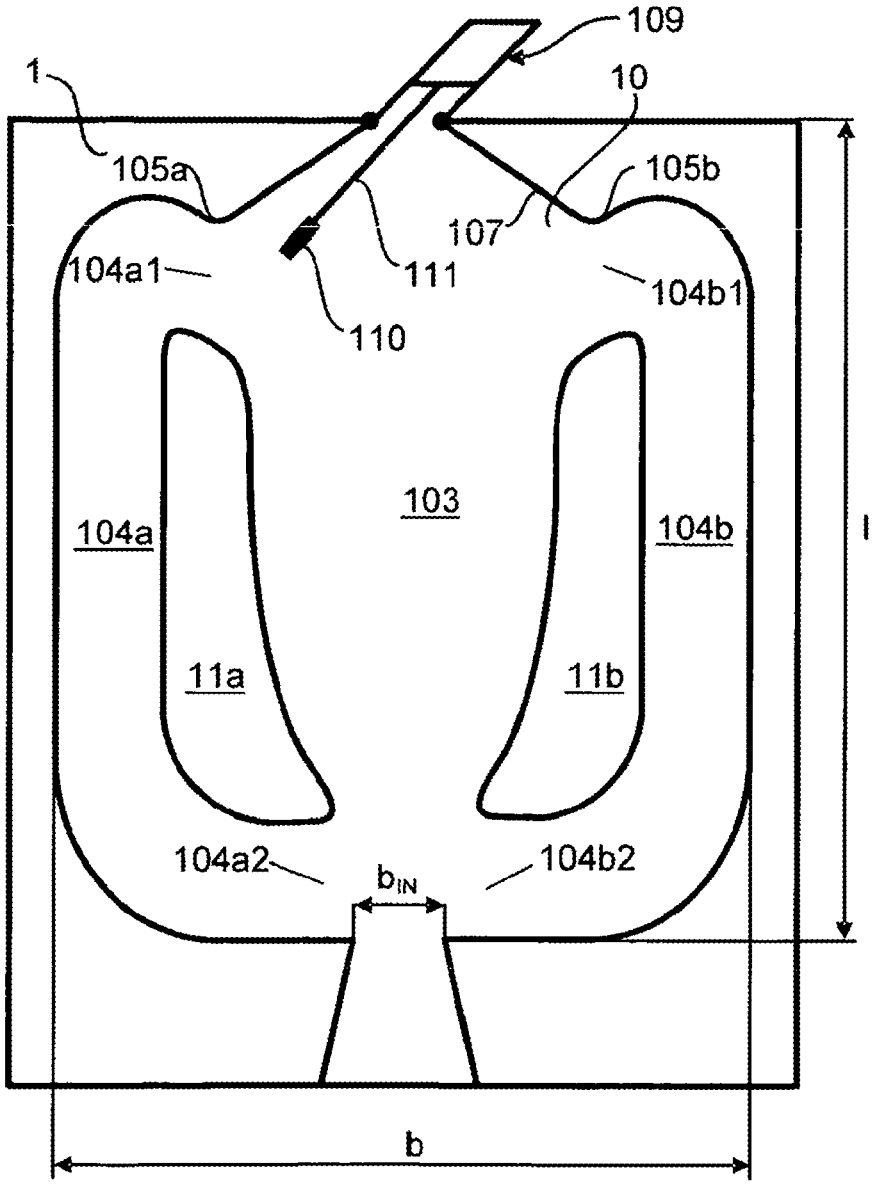
FIG. 13 shows the fluidic component from FIG. 12 having a flow guiding body.

Another embodiment of the fluidic component 1 having the fluid flow guide 109 from FIG. 12 is illustrated in FIG. 13. The fluidic component 1 additionally has a flow guiding body 110, which is attached to the fluid flow guide 109 by means of a holder 111. The flow guiding body 110 serves to assist the deflection of the fluid flow emerging from the outlet opening 102 and hence also to assist the movement of the fluid flow guide 109 by exploiting the fluid dynamics in the flow chamber 10. Here, the holder 111 is configured in such a way that it does not disturb the oscillation mechanism of the emerging fluid flow. In particular, the holder has a small cross section and hence a negligible flow resistance. The holder 111 forms a rigid connection between the flow guiding body 110 and the fluid flow guide 109. The fluid guiding body 110 is therefore not movable relative to the fluid flow guide 109 but can only be moved together with the fluid flow guide 109. The shape of the flow guiding body 110 can be configured in different ways. In particular, the flow guiding body 110 can be streamlined in shape. The rectangular shape, illustrated in FIG. 13, of the flow guiding body 110 is only a schematic illustration.

The flow guiding body 110 described with reference to FIG. 13 is not restricted to the fluidic component 1 illustrated in FIG. 13 but can also be used in other fluidic components 1 that have a fluid flow guide 109. The fluid flow guide 109 can also be used in other fluidic components, apart from those in FIGS. 12 and 13.

Figure 14:
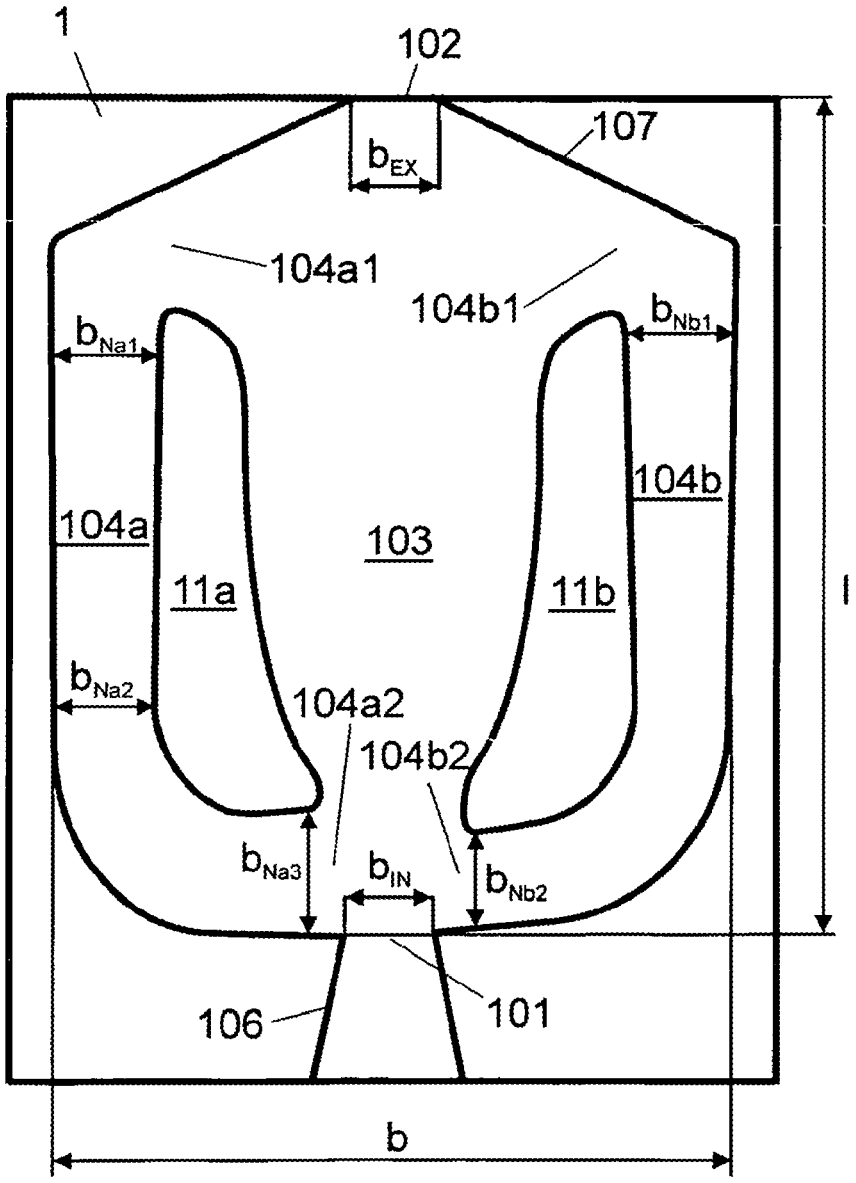
FIG. 14 shows a cross section through a fluidic component according to another embodiment.

FIG. 14 shows a fluidic component 1 which corresponds substantially to the fluidic component 1 from FIG. 1. The fluidic component 1 from FIG. 14 differs from that from FIG. 1 in that the cross-sectional area of the auxiliary flow channels 104*a*, 104*b* is not constant over the length thereof. The component depth of the fluidic component 1 from FIG. 14 is constant over the entire fluidic component 1. The cross-sectional area of the auxiliary flow channels 104*a*, 104*b* is accordingly achieved by means of a change in the width thereof.

Thus, auxiliary flow channel 104*a* has a greater width at the inlet 104*a*1 thereof and at the outlet 104*a*2 thereof than in a section between the inlet 104*a*1 and the outlet 104*a*2. For the widths $b_{Na1}$, $b_{Na2}$, $b_{Na3}$ of auxiliary flow channel 104*a* which are illustrated in FIG. 14, $b_{Na1}>b_{Na2}$ and $>b_{Na3}>b_{Na2}$. In this case, $b_{Na3}>b_{Na1}$, but it can also be the case that $b_{Na3}=b_{Na1}$ or $b_{Na3}<b_{Na1}$.

Auxiliary flow channel 104*b* has a greater width at the inlet 104*b*1 thereof than at the outlet 104*b*2 thereof. For the widths $b_{Nb1}$, $b_{Nb2}$ of auxiliary flow channel 104*b* which are illustrated in FIG. 14, $b_{Nb1}>b_{Nb2}$. As an alternative (depending on the application), the inlet width can be less than the outlet width.

In FIG. 14, the width of the auxiliary flow channels 104*a*, 104*b* changes differently over the length thereof. This is achieved by virtue of the fact that the two blocks 11*a*, 11*b* are of different design in respect of shape and size and are not oriented symmetrically relative to mirror plane S2. As a result, the shape of the main flow channel 103 is also not symmetrical relative to mirror plane S2. However, both auxiliary flow channels 104*a*, 104*b* can be the same in respect of the change in their width.

By means of the change in the cross-sectional area of the auxiliary flow channels 104*a*, 104*b*, the production process (casting, sintering) of the fluidic component 1 can be simplified since foreign matter can be removed easily from the fluidic component during manufacture. Moreover, the finished fluidic component can be cleaned more easily, this being significant, for example, when the fluidic component is used with a fluid that is laden with foreign matter (particles). In the variant in which the cross section increases from the outlet of the auxiliary flow channel toward the inlet of the auxiliary flow channel, the fluidic component is self-flushing during operation. In the variant in which the cross section increases from the inlet of the auxiliary flow channel toward the outlet of the auxiliary flow channel, the fluid drains completely from the fluidic component when the fluidic component is switched off (i.e., when no more fluid is passed into the fluidic component). It is thus possible to avoid the accumulation of fluid in the fluidic component after it has been switched off and the proliferation of pathogens (e.g., *legionella*) present in the fluid or the deposition of mold, soap residues, limescale or other dirt. Draining of the fluidic component after switching off can be promoted by dispensing with separators.

However, the variable width of the auxiliary flow channels 104*a*, 104*b* which is described with reference to FIG. 14 is not restricted to the fluidic component 1 illustrated in FIG. 14. On the contrary, the variable width of the auxiliary flow channels/of the auxiliary flow channel can also be applied to other shapes of fluidic components having one or more auxiliary flow channels.

Figure 15:
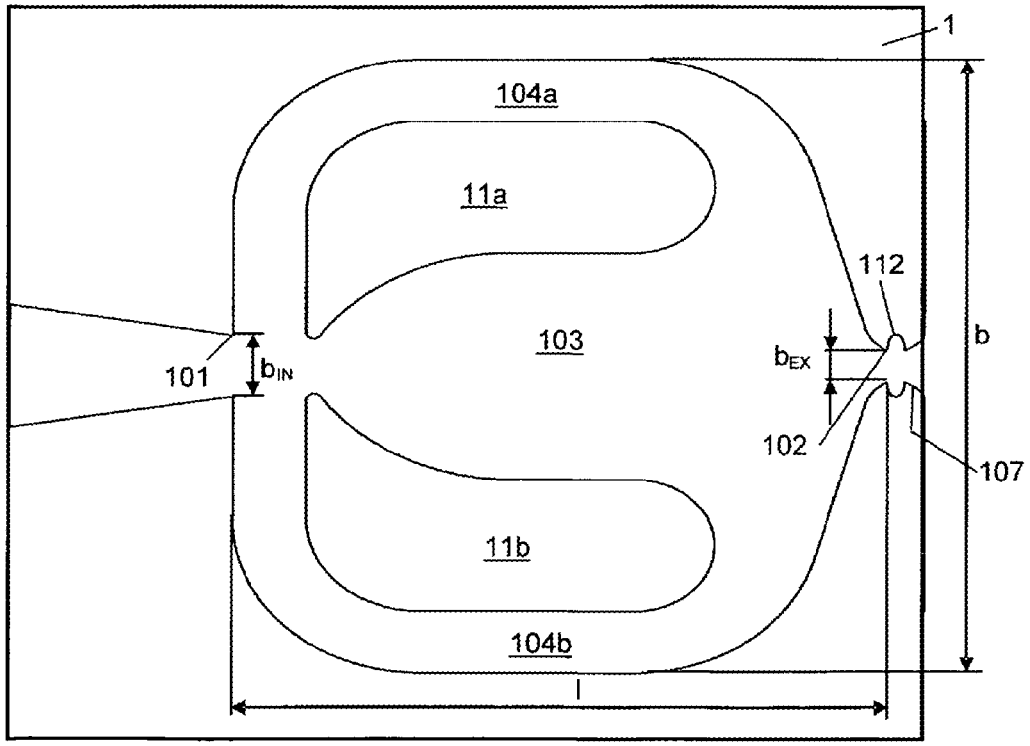
FIG. 15 shows a cross section through a fluidic component having a cavity.

FIG. 15 illustrates a fluidic component 1 which has a cavity 112 downstream of the outlet opening 102. In other respects, it corresponds to the fluidic component from FIG. 4*d*). The cavity 112 is an annular widened portion of the outlet channel 107 adjoining the outlet opening 102, said portion extending over a section of the outlet channel 107 (when viewed in the flow direction of the emerging fluid flow). An annular widened portion should be taken to mean a widened portion which has a continuous round, polygonal or oval contour or a continuous contour of some other shape. In FIG. 15, the cavity is arranged directly at the outlet opening 102. However, it can be arranged further downstream. The cavity 112 reduces the boundary layer depth of the fluid flow emerging from the outlet opening 102. This increases the compactness of the emerging fluid flow, i.e., the extent of the emerging fluid flow transversely to the flow direction. The cavity 112 can be provided for a very wide variety of embodiments of a fluidic component 1 and is not restricted to the fluidic component from FIG. 15.

The shapes of the fluidic components 1 in FIGS. 1 to 15 are merely illustrative. The invention can also be applied to already known fluidic components.

Figure 16:
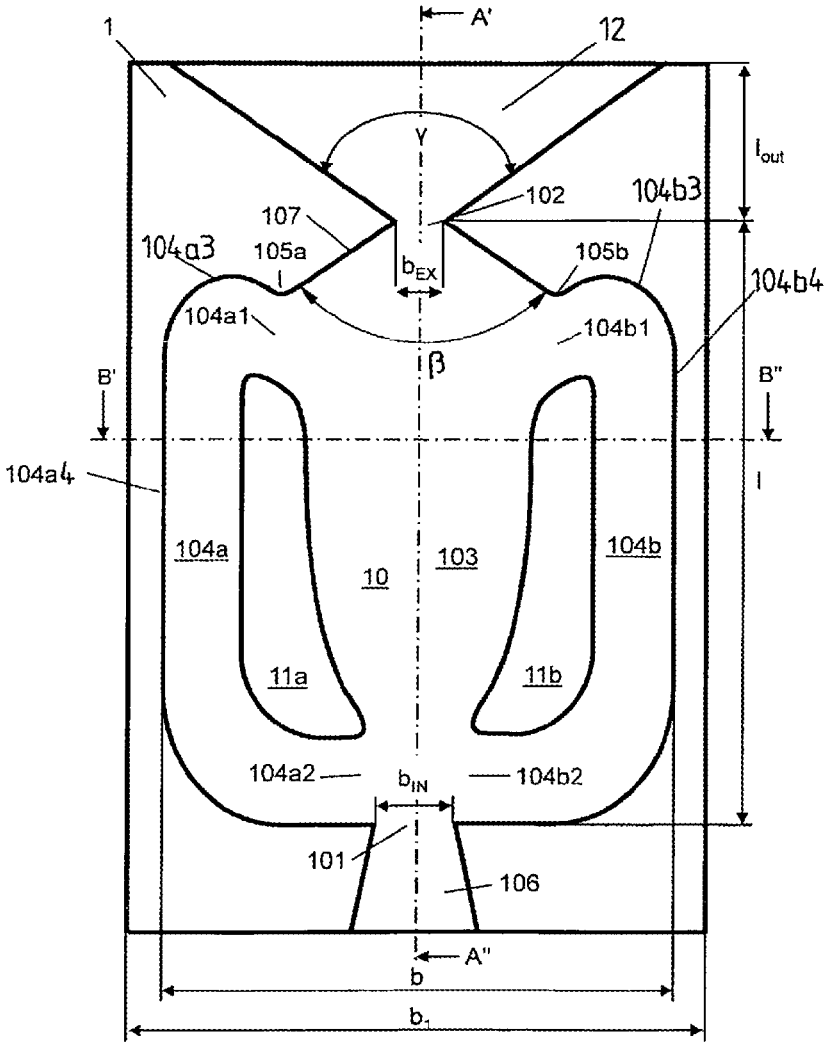
FIG. 16 shows a cross section through a fluidic component according to another embodiment of the invention.
Figure 17:
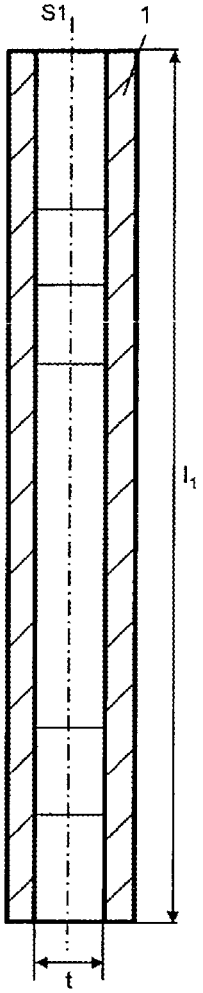
FIG. 17 shows a section through the fluidic component from FIG. 16 along the line A'-A".
Figure 18:
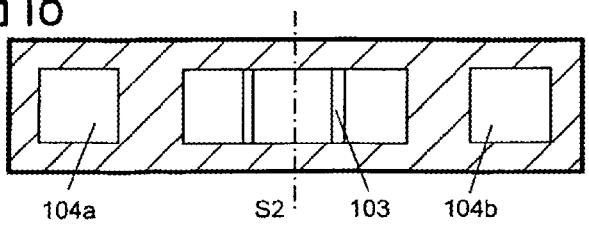
FIG. 18 shows a section through the fluidic component from FIG. 16 along the line B'-B".

A fluidic component 1 according to another embodiment of the invention is illustrated schematically in FIG. 16. FIGS. 17 and 18 show a section through this fluidic component 1 along the lines A'-A" and B'-B" respectively. The fluidic component 1 from FIGS. 16 to 18 corresponds substantially to the fluidic component from FIGS. 1 to 3. In particular, the fluidic component 1 from FIGS. 16 to 18 differs from the fluidic component from FIGS. 1 to 3 in that a widened outlet portion 12 is provided. The widened outlet portion 12 adjoins the outlet opening 102 downstream. Thus, the fluid flow 2 moves from the outlet opening 102 through the widened outlet portion 12 before the fluid flow 2 emerges from the fluidic component 1.

If the cross-sectional area of the outlet opening 102 is smaller than the cross-sectional area of the inlet opening 101, the pressure within the fluidic component 1 can increase and thus reduce the tendency for cavitation. As a result, the input pressure, which can be higher than 14 bar (above ambient pressure) but can also be over 1000 bar and is preferably between 20 bar and 500 bar, is dissipated essentially only at the outlet opening 102. Owing to the large pressure decrease directly at the outlet opening 102, the emerging fluid jet can tend to spread apart (in all directions). This spreading apart can be counteracted (at least partially) by means of the widened outlet portion 12. By means of the widened outlet portion 12, it is possible to achieve concentration of the emerging fluid jet (perpendicularly to the planes of symmetry S1 and S2). By means of this concentration of the fluid jet, an increase in the removal or cleaning power of the fluidic component 1 can be achieved.

The widened outlet portion 12 is of funnel-shaped design and has a cross-sectional area which increases in the fluid flow direction (from the inlet opening 101 to the outlet opening 102), starting from the outlet opening 102. In this case, the depth of the widened outlet portion 12 is constant, while the width of the widened outlet portion 12 increases in the fluid flow direction. According to FIG. 16, the width increases in linear fashion. However, some continuous increase other than the linear increase of the width is also possible. The outlet opening 102 forms the point with the smallest cross-sectional area between the flow chamber 10 and the widened outlet portion 12.

The walls delimiting the widened outlet portion 12 enclose an angle $\gamma$ in the plane in which the emerging fluid jet oscillates. In the embodiment from FIG. 16, the angle $\gamma$ corresponds to the oscillation angle $\alpha$ of the emerging fluid jet which would form without the widened outlet portion 12. The angle $\gamma$ can also be larger than the corresponding oscillation angle α. In the case of a fluidic component 1 which produces a uniform distribution of the fluid on the surface to be sprayed (also known as a histogram) without a widened outlet portion 12, it is advantageous if the angle γ is up to 10° larger than the oscillation angle α. In the case where a fluidic component 1 without a widened outlet portion 12 produces a nonuniform distribution of the fluid on the surface to be sprayed (e.g., more fluid in the center than in the edge regions) or in the case where a smaller spray angle or oscillation angle α is desired, a widened outlet portion 12, the angle γ of which corresponds to the desired reduced oscillation angle α, can be provided. On the one hand, this produces a smaller oscillation angle α and, on the other hand, it produces more uniform distribution of the fluid on the surface to be sprayed or in the histogram.

The walls delimiting the outlet channel 107 enclose an angle β in the plane in which the emerging fluid jet oscillates. The angle β of the outlet channel 107 can be larger than the oscillation angle α and also larger than the angle γ of the widened outlet portion 12. The angle β of the outlet channel 107 is preferably larger than the angle γ of the widened outlet portion 12 by a factor of at least 1.1. According to a particularly preferred embodiment, $1.1*\gamma \leq \beta \leq 3.5*\gamma$.

The widened outlet portion 12 has a length $l_{out}$ which adjoins the component length 1. The length $l_{out}$ of the widened outlet portion 12 can correspond at least to the width $b_{EX}$ of the outlet opening 102. The length $l_{out}$ of the widened outlet portion 12 can preferably be greater by a factor of at least 1.25 than the width $b_{EX}$ of the outlet opening 102. The length $l_{out}$ of the widened outlet portion 12 can preferably be greater by a factor of 1 to 32 than the outlet width $b_{EX}$, in particular preferably by a factor of 4 to 16. At this ratio, a fluid jet of high jet quality can be produced.

The separators 105*a*, 105*b* are formed by an inward protrusion of the wall of the auxiliary flow channels 104*a*, 104*b*. In this case, the inward protrusion has a shape which describes a circular arc in plane of symmetry S1. The radius of the circular arc can vary. For example, the radius of the circular arc can be 0.0075 to 2.6 times, preferably 0.015 to 1.8 times and, in particular, preferably 0.055 to 1.7 times the outlet width $b_{EX}$.

In the illustrative embodiment in FIGS. 16 to 18, the component depth t is constant over the entire widened outlet portion 12 and corresponds to the component depth at the outlet opening 102. Depending on the area of application of the fluidic component 1, the depth t of the widened outlet portion 12 can increase or decrease downstream (in comparison with the component depth at the outlet opening 102). By means of a downstream decrease in the component depth in the region of the widened outlet portion 12, further focusing of the emerging fluid jet can be achieved.

Figure 19:
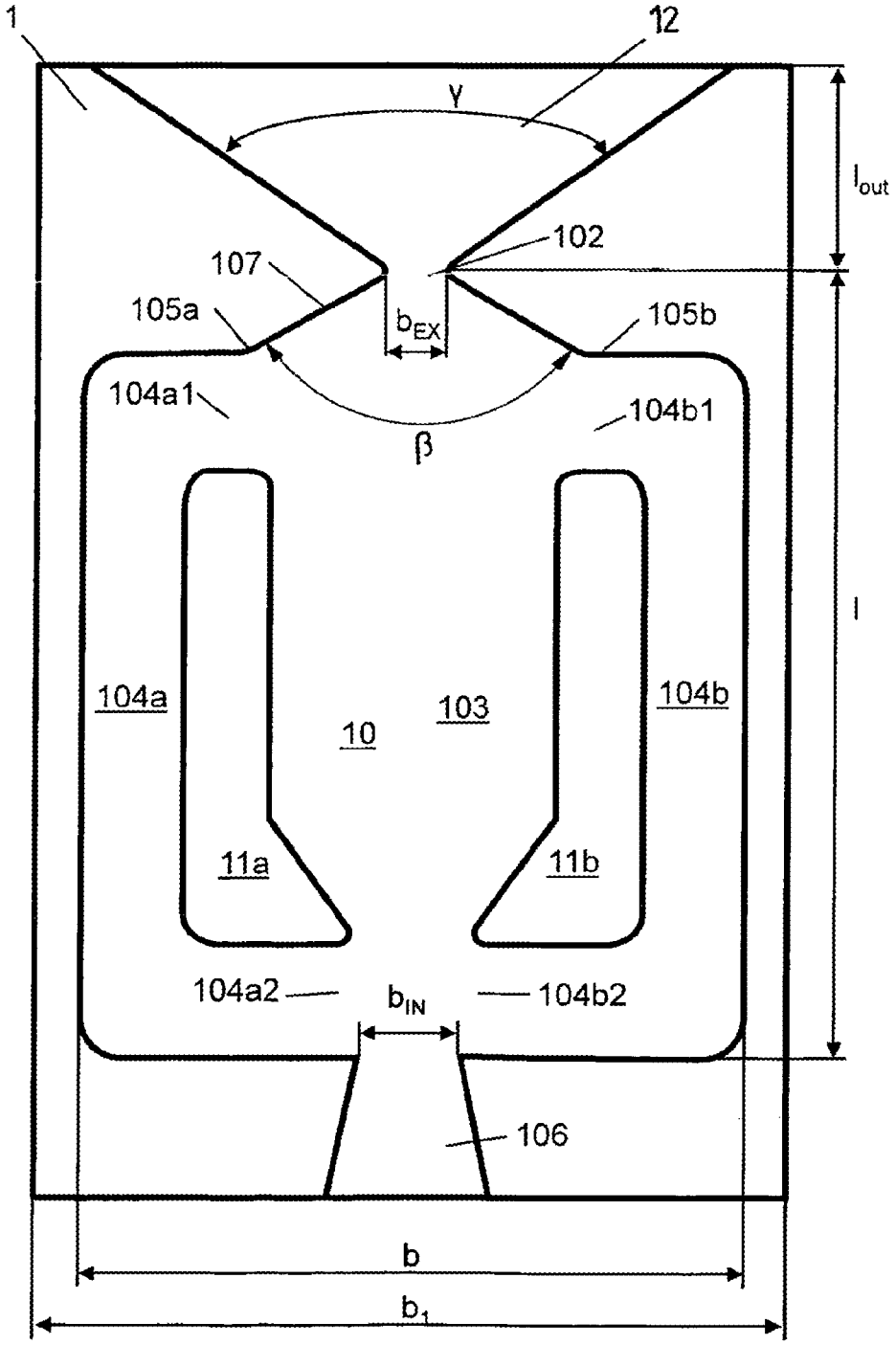
FIG. 19 shows a cross section through a fluidic component according to another embodiment of the invention.

A fluidic component 1 according to another embodiment of the invention is illustrated schematically in FIG. 19. This fluidic component 1 too, like the fluidic component 1 from FIG. 16, has a widened outlet portion 12. The shapes of the auxiliary flow channels 104*a*, 104*b*, of the blocks 11*a*, 11*b* and of the separators 105*a*, 105*b* are similar to the shapes of the fluidic component 1 from FIG. 7*d*). The basic shape of the fluidic component 1 from FIG. 19 is substantially rectangular. The blocks 11*a* and 11*b* have a substantially rectangular basic shape, adjoining which at the end thereof facing the inlet opening 101 is a triangular projection, which projects into the main flow channel. The blocks 11*a* and 11*b* can be sharp-edged or slightly rounded at the intersection points of the rectilinear sections, as illustrated in FIG. 19.

The auxiliary flow channels 104*a*, 104*b* each extend initially at an angle of substantially 90° to the longitudinal axis A in opposite directions in a first section, starting from the inlet opening 101. The auxiliary flow channels 104*a*, 104*b* then bend (substantially at a right angle), with the result that they each extend substantially parallel to the longitudinal axis A (in the direction of the outlet opening 102) (second section). A third section adjoins the second section. The change in direction at the transition from the second to the third section is substantially 90°.

In contrast to the fluidic component 1 from FIG. 16, the separators 105*a*, 105*b* are not formed by an inward protrusion of the wall of the auxiliary flow channels 104*a*, 104*b* but by the transition of the rectilinear third section of the auxiliary flow channels 104*a*, 104*b* (which extends substantially perpendicularly to the longitudinal axis A and to plane of symmetry S2) to the wall of the outlet channel 107, which encloses an angle of less than 90° with the longitudinal axis A (and plane of symmetry S2). The separators 105*a*, 105*b* are accordingly formed by an edge. As an alternative, the separators 105*a*, 105*b* can have a shape which describes a circular arc in plane of symmetry S1 (as in the embodiment from FIGS. 16 to 18). In the embodiment according to FIG. 19, the third section of the auxiliary flow channels 104*a*, 104*b* extends substantially perpendicularly to plane of symmetry S2, but the angle can also differ from 90°. The separators 105*a*, 105*b* can preferably be arranged at a distance from plane of symmetry S2 which is within the average width of the blocks 11*a*, 11*b*.

The shape of the fluidic components 1 having a widened outlet portion 12 is shown purely by way of example in FIGS. 16 to 19. The widened outlet portion 12 can also be provided in combination with other embodiments of the fluidic component 1 according to the invention.

The invention claimed is:

1. A fluidic component having a flow chamber allowing a fluid flow to flow through, said fluid flow entering the flow chamber through an inlet opening of the flow chamber and emerging from the flow chamber through an outlet opening of the flow chamber, and which flow chamber has at least one means for changing the direction of the fluid flow at the outlet opening in a controlled manner to generate a spatial oscillation of the fluid flow at the outlet opening, wherein the flow chamber has a main flow channel, which interconnects the inlet opening and the outlet opening, and at least one auxiliary flow channel as a means for changing the direction of the fluid flow at the outlet opening in a controlled manner, and wherein the inlet opening has a larger cross-sectional area than the outlet opening, wherein the cross-sectional areas of the inlet opening and of the outlet opening are the smallest cross-sectional areas of the fluidic component through which the fluid flow passes when it enters the flow chamber and reemerges from the flow chamber, respectively, and wherein the fluid flow enters the fluidic component via the inlet opening under a pressure and in that the pressure is substantially dissipated at the outlet opening; and wherein the cross-sectional area of the inlet opening is larger by a factor of up to 2.5 compared to the cross-sectional area of the outlet opening.

2. The fluidic component as claimed in claim 1, wherein the fluidic component has a component length, a component width and a component depth, wherein the component length determines the distance between the inlet opening and the outlet opening, and the component width and the component depth are each defined perpendicularly to one another and to the component length, wherein the component width is greater than the component depth, and in that the outlet opening has a width which is 1/3 to 1/50 of the component width, wherein the inlet opening has a width which is 1/3 to 1/20 of the component width.

3. The fluidic component as claimed in claim 1, wherein the component depth is constant over the entire component length or decreases from the inlet opening toward the outlet opening.

4. The fluidic component as claimed in claim 1, wherein the at least one auxiliary flow channel has a greater or smaller depth than the main flow channel.

5. The fluidic component as claimed in claim 1, wherein a separator is provided at the inlet of the at least one auxiliary flow channel, wherein the separator is designed as an inward protrusion which projects into the flow chamber transversely to the flow direction prevailing in the auxiliary flow channel.

6. The fluidic component as claimed in claim 1, wherein the cross-sectional area of the outlet opening is rectangular, polygonal or round.

7. The fluidic component as claimed in claim 1, wherein an outlet channel, the cross-sectional area of which changes in shape in the direction of the outlet opening is provided directly upstream of the outlet opening.

8. The fluidic component as claimed in claim 7, wherein the fluidic component has a cavity, which is designed as a widened portion of the outlet channel and, when viewed in the flow direction of the emerging fluid flow, extends around the entire outlet channel over a section of the outlet channel and transversely to the flow direction of the emerging fluid flow.

9. The fluidic component as claimed in claim 7, wherein the cross-sectional area of the outlet channel changes in shape in the direction of the outlet opening from rectangular to round.

10. The fluidic component as claimed in claim 1, wherein the fluidic component has two or more outlet openings, which are formed by arrangement of a flow divider directly upstream of the outlet openings, wherein the outlet openings each have a smaller cross-sectional area than the inlet opening, or the outlet openings and the inlet opening each have cross-sectional areas that are equal in size.

11. The fluidic component as claimed in claim 1, wherein the outlet opening is adjoined on the downstream side by a fluid flow guide which, without acting on the direction of the fluid flow is movable by the fluid flow as said flow changes direction.

12. The fluidic component as claimed in claim 11, wherein the fluid flow guide is rigidly connected to a flow guiding body, which is arranged upstream of the outlet opening and is movable by the fluid flow as said flow changes direction.

13. The fluidic component as claimed in claim 1, wherein a widened outlet portion follows downstream of the outlet opening.

14. The fluidic component as claimed in claim 13, wherein the widened outlet portion has a width which increases downstream of the outlet opening.

15. The fluidic component as claimed in claim 13, wherein the widened outlet portion is delimited by a wall which encloses an angle $\gamma$ in a plane in which the emerging fluid jet oscillates within an oscillation angle $\alpha$, wherein the angle $\gamma$ of the widened outlet portion is 0° to 15° larger than the oscillation angle $\alpha$.

16. The fluidic component as claimed in claim 13, wherein the cross-sectional area of said widened portion increases downstream from the outlet opening.

17. A cleaning appliance having a device for producing a fluid jet, wherein the cleaning appliance is a dishwasher, an industrial cleaning system, a washing machine or a high-pressure cleaner, wherein the device is a fluidic component as claimed in claim 1.

18. An injection system for injecting a fuel into a combustion engine having a device for producing a fluid jet, wherein the device is a fluidic component as claimed in claim 1.

* * * * *